US006950619B2

(12) United States Patent
Sunohara

(10) Patent No.: US 6,950,619 B2
(45) Date of Patent: Sep. 27, 2005

(54) IMAGE FORMING APPARATUS

(75) Inventor: Takahiro Sunohara, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 10/844,548

(22) Filed: May 13, 2004

(65) Prior Publication Data

US 2004/0228655 A1 Nov. 18, 2004

(30) Foreign Application Priority Data

May 16, 2003 (JP) ..... 2003-138464

(51) Int. Cl.[7] ..... G03G 15/00

(52) U.S. Cl. ..... 399/124; 219/216; 399/21; 399/124; 399/125; 399/326

(58) Field of Search ..... 399/21, 124, 125, 399/328; 219/216

(56) References Cited

U.S. PATENT DOCUMENTS 5,045,887 A * 9/1991 Nakamura ..... 399/122
5,260,743 A * 11/1993 Sakamoto ..... 399/4
2002/0051650 A1 * 5/2002 Ando et al. ..... 399/67
2002/0176724 A1 * 11/2002 Fuma et al. ..... 399/328

FOREIGN PATENT DOCUMENTS

JP 09016030 * 1/1997 ..... G03G/21/00
JP 09274421 * 10/1997 ..... G03G/21/16
JP 2000-019927 1/2000

* cited by examiner

*Primary Examiner*—Arthur T. Grimley
*Assistant Examiner*—Peter Lee
(74) *Attorney, Agent, or Firm*—Rabin & Berdo, P.C.

(57) ABSTRACT

An image forming apparatus includes a transferring-and-feeding unit (103) including a transfer belt (110). The transferring-and-feeding unit (103) is supported by a support frame (115) swingable in the direction away from image forming portions (100) including photosensitive bodies (107). The fixing unit (104) includes release members (121) that bring a heat roller (117) and the pressure roller (118) to stop pressing the recording medium. As the support frame (115) swings, the transfer belt (110) separates from the photosensitive bodies (107), and the heat roller (117) and the pressure roller (118) stop pressing the recording medium, with the result that the recording medium can easily removed from the image forming apparatus.

10 Claims, 18 Drawing Sheets

IMAGE FORMING APPARATUS

BACKGROUND OF THE INVENTION

This invention relates to an image forming apparatus that forms an image on a recording medium using electrophotographic technology or the like.

In the image forming apparatus, a toner image is formed on an image bearing body (for example, a photosensitive body) according to image data, transferred to a recording medium by a transferring unit, and fixed to the recording medium by a fixing unit. When the jam of the recording medium occurs in the image forming apparatus, it is necessary that the recording medium can be easily removed from the image forming apparatus. Thus, Japanese Patent Kokai publication No. 2000–19927 (pages 4 to 7 and FIG. 2) discloses a mechanism that brings a heat roller and a pressure roller of the fixing unit to stop pressing the recording medium when a lever is operated or an outer cover is opened.

However, the recording medium is not only pressed between the fixing portion but also nipped between the image bearing body and a transfer belt or the like. Thus, in order to remove the recording medium from the image forming apparatus, it is necessary to separate the heat roller and the pressure roller from each other and also separate the image bearing body and the transfer belt from each other, and therefore the operation becomes complicated. Moreover, when the recording medium is pulled out from the downstream side of the fixing unit, the unfixed toner image on the recording medium may adhere to the surface of the heat roller or the pressure roller.

SUMMARY OF THE INVENTION

An object of the present invention is to provide an image forming apparatus from which a recording medium can be easily removed.

According to the invention, there is provided an image forming apparatus including an image bearing body that bears a developer image formed by developer, a transfer body that transfers the developer image to a recording medium and feeds the recording medium, a separating mechanism that separates the image bearing body and the transfer body from each other, and a fixing unit that fixes the developer image to the recording medium. The fixing unit includes a heating body and a pressure body. The image forming apparatus further includes a pressing mechanism that presses the heating body and the pressure body against each other so that the recording medium is pressed between the heating body and the pressure body, and a release mechanism that brings the pressing mechanism to stop pressing the heating body and the pressure body. The release mechanism is linked with the separating mechanism.

With such an arrangement, as the transfer body and the image bearing body separate from each other, the heating body and the pressure body stop pressing the recording medium therebetween. Therefore, even if the recording medium is nipped between the transfer body and the image bearing body, and is pressed between the heating body and the pressure body, the recording medium can be easily removed from the image forming apparatus.

DETAILED DESCRIPTION OF THE INVENTION

Embodiments of the present invention will be described with reference to the attached drawings.

First Embodiment.

Figure 1:
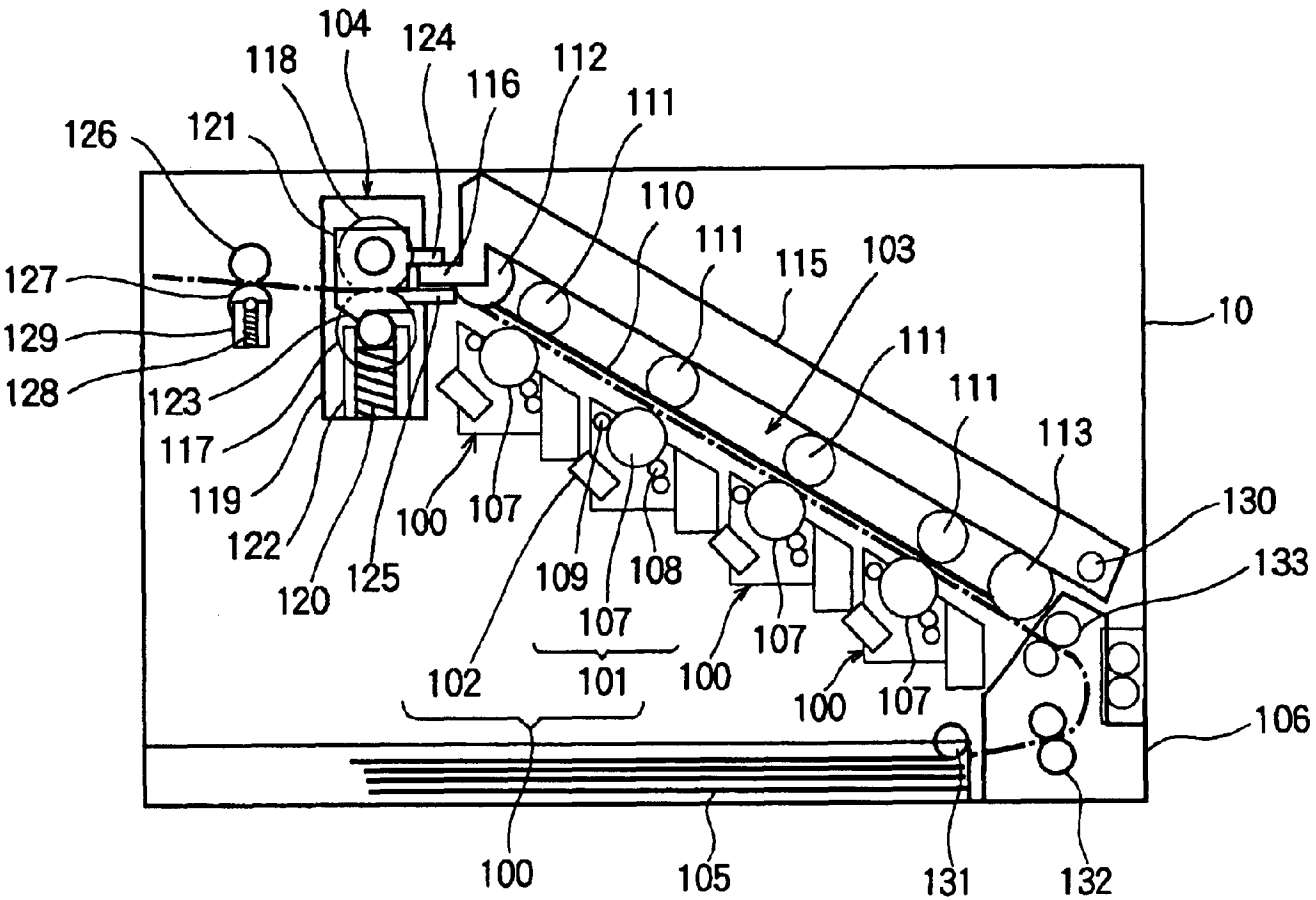
FIG. 1 is a sectional view of an image forming apparatus according to the first embodiment.

FIG. 1 is a sectional view of the whole structure of an image forming apparatus according to the first embodiment. The image forming apparatus uses electrophotographic technology, and forms an image on a recording media (for example, a recording paper) according to the image data inputted from an external computer or the like. The image forming apparatus includes four image forming portions 100, a transferring-and-feeding unit 103, a fixing unit 104, a medium tray 105, and a medium supply unit 106. These units are accommodated in the housing 10.

The four image forming portions 100 respectively form toner images (i.e., developer images) of yellow, magenta, cyan and black on the recording medium. In the housing 10, the four image forming portions 100 are aligned in the direction from the lower right to the upper left of the housing 10 in FIG. 1. Each image forming portion 100 includes an image drum cartridge 101. The image drum cartridge 101 includes a photosensitive body (i.e., an image bearing body) 107, a developing unit 108 and a charging unit 109. Each image forming portion 100 further includes an optical unit 102 constituted by an LED (Light Emitting Diode) head. The LED head includes a plurality of LED elements aligned in the direction parallel to the axis of each photosensitive body 107. The optical unit 102 is not limited to the LED head, but can be constituted by, for example, a laser scanning unit including a laser emitting portion and a polygon mirror.

The photosensitive body 107 takes the form of a drum and is driven by a not shown driving source. The photosensitive body 107 has a photosensitive layer on the surface thereof. The charging unit 109 uniformly charges the surface of the photosensitive body 107. The optical unit 102 irradiates the light to the uniformly charged surface of the photosensitive body 107, and forms a latent image. The developing unit 108 develops a latent image on the surface of photosensitive body 107 and forms a toner image, i.e., a developer image.

The transferring-and-feeding unit 103 includes four transfer rollers 111 aligned in the direction from the lower right to the upper left in FIG. 1 so that the four transfer rollers 111 respectively oppose the photosensitive bodies 107. The transferring-and-feeding unit 103 further includes a belt driving roller 112 and a tension applying roller 113. The belt driving roller 112 and the tension applying roller 113 are disposed on both sides of the transfer rollers 111 in the direction in which the transfer rollers 111 are aligned. An endless transfer belt 110 (i.e., a transfer body) is stretched over the belt driving roller 112 and the tension applying roller 113 so that the transfer belt 110 is nipped between the transfer rollers 111 and the photosensitive bodies 107. A bias voltage is applied to each transfer roller 111 so that the toner image is transferred from each photosensitive body 107 to the recording medium by means of an electric charge on the transfer belt 110.

The belt driving roller 112 is rotated by a not-shown driving source. When the belt driving roller 112 rotates, the transfer belt 110 moves and circulates in one direction. The tension applying roller 113 applies tension to the transfer belt 110. A feeding path of the recording medium is formed between the transfer belt 110 and the photosensitive bodies 107. As the photosensitive bodies 107 rotate and the transfer belt 110 moves, the recording medium is fed along the feeding path between the transfer belt 110 and the photosensitive bodies 107 in the direction from the lower right to the upper left in FIG. 1. Hereinafter, the upstream side in the feeding direction of the recording medium is simply referred to as "the upstream side". The downstream side in the feeding direction of the recording medium is simply referred to as the "the downstream side".

The medium tray 105 is attached to the bottom portion of the housing 10. The stack of the recording media is accommodated in the medium tray 105. The medium supply unit 106 is disposed on the right side of the medium tray 105 in FIG. 1. The medium supply unit 106 includes a pickup roller 131, a delivery roller 132 and a feeding roller 133. The pickup roller 131 successively picks up the medium from the stack accommodated in the medium tray 105. The delivery roller 132 and the feeding roller 133 feed the recording medium, picked up by the pickup roller 131, into the above described feeding path.

The fixing unit 104 is disposed on the upper left side of the housing 10, i.e., the downstream side of four image forming portions 100. The fixing unit 104 includes a heat roller (i.e., a heating body) 117, a pressure roller 118 (i.e., a pressure body) disposed on the upper side of the heat roller 117, and a fixing unit cover 119. The fixing unit 104 further includes two pressing members 120 (i.e., a pressing mechanism) for pressing the heat roller 117 against the pressure roller 118 so that the recording medium is pressed between the heat roller 117 and the pressure roller 118. Although only one pressing member 120 is shown in FIG. 1, two pressing members 120 are disposed on both sides of the heat roller 117 in the longitudinal direction of the heat roller 117. Two release members 121 (i.e., a release mechanism) are provided for bringing the heat roller 117 and the pressure roller 118 stop pressing the recording medium. Although only one release member 121 is shown in FIG. 1, two release members 121 are disposed on both sides of the pressure roller 118 in the longitudinal direction of the pressure roller 118.

The pressure roller 118 rotates in one direction by means of a not shown driving source. The heat roller 117 is supported by guide members 122 in such a manner that the heat roller 117 is movable in the vertical direction, i.e., in the direction toward and away from the pressure roller 118. Each pressing member 120 is in the form of, for example, a spring member. The pressing members 120 abut against both ends of the shaft (hereinafter, referred to as shaft ends) of the heat roller 117 and press the heat roller 117 against the pressure roller 118. The release members 121 are rotatably supported by the shaft of the heat roller 118. The release members 121 have cam portions 123 that abut against the shaft ends of the heat roller 117.

An eject roller 126 is disposed on the downstream side of the fixing unit 104 for ejecting the recording medium (that has passed through the fixing unit 104) to the exterior of the housing 10. The eject roller 126 is rotated in one direction by a not shown driving source. A feeding roller 127 is disposed on the lower side of the eject roller 126, and supported by guide members 129 in such manner that the feeding roller 127 is movable in the vertical direction, i.e., in the direction toward and away from the eject roller 126. Two pressing members 128 are disposed on the lower side of the feeding roller 127. Each pressing member 128 is made of, for example, a spring member. Although only one pressing member 128 is shown in FIG. 1, two pressing members 128 are disposed on both sides of the feeding roller 127 in the longitudinal direction of the feeding roller 127. The pressing members 128 urge the shaft ends of the feeding roller 127 toward the eject roller 126 so that the recording medium is nipped between the eject roller 126 and the feeding roller 127. The eject roller 126 and the feeding roller 127 constitute a feeding mechanism.

The transferring-and-feeding unit 103 is detachably attached to a support frame 115 (i.e., a separating mechanism) swingably provided in the housing 10. The support frame 115 is swingably supported by a support shaft 130 disposed on the lower right (i.e., in the vicinity of the medium supply unit 106) of the housing 10 in FIG. 1. The position of the support frame 115 when the feeding path is formed between the transfer belt 110 and the photosensitive bodies 107 as shown in FIG. 1 is referred to as "a closing position". The support frame 115 is locked at the closing position by a lock mechanism (not shown) provided in the housing 10.

Figure 2:
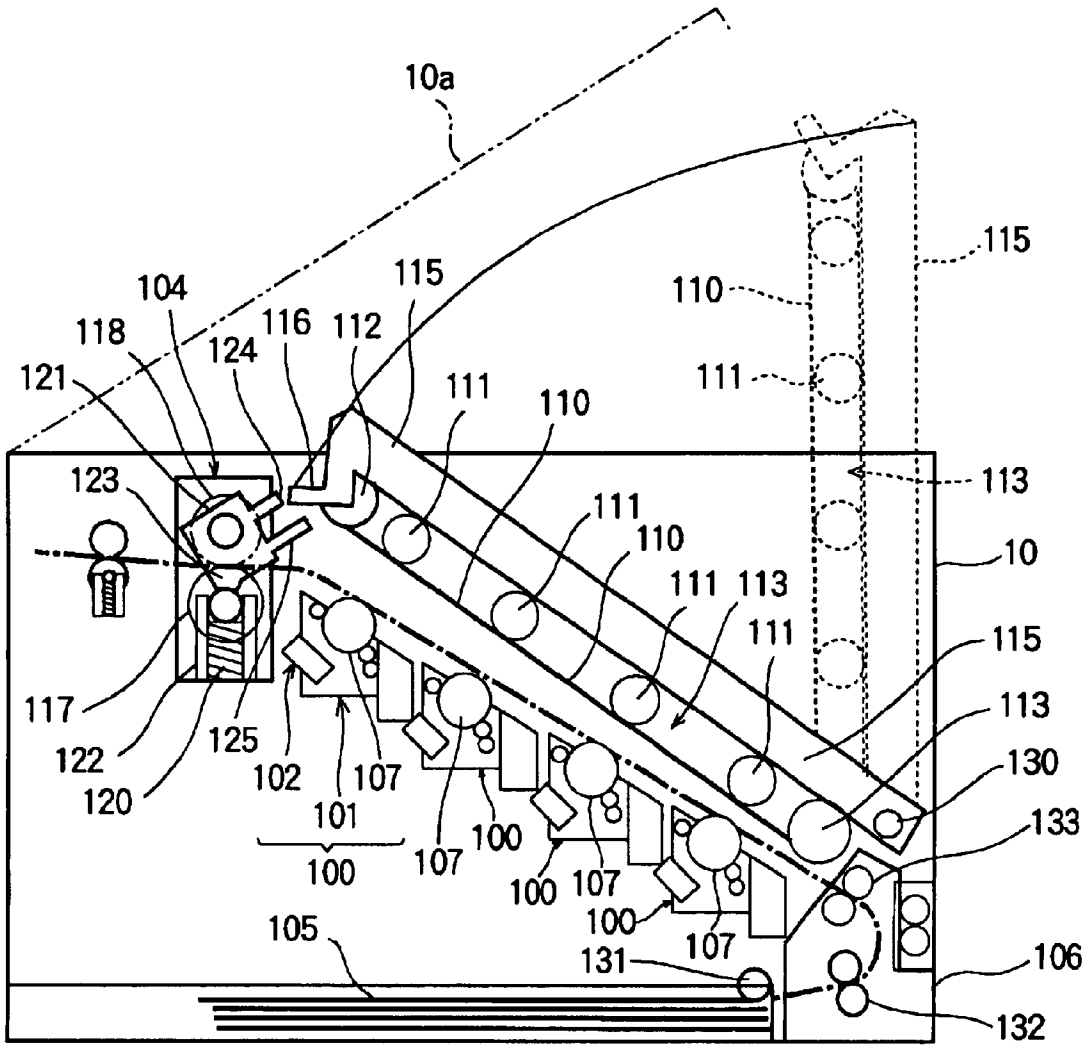
FIG. 2 is a sectional view illustrating the operation of the image forming apparatus according to the first embodiment.

FIG. 2 is a sectional view illustrating the swinging of the support frame 115 to which the transferring-and-feeding unit 103 is mounted. In FIG. 2, the support frame 115 that has just started swinging is shown by a solid line, and the support frame 115 that has finished swinging is shown by a dashed line. As shown by dashed line in FIG. 2, the support frame 115 is able to swing to a position (referred to as "an opening position") in which the transfer rollers 111 are substantially aligned in the vertical direction. When the support frame 115 swings from the closing position to the opening position, the feeding path of the recording medium is opened. The state in which the feeding path is "opened" is that the transfer belt 110 separates from the photosensitive bodies 107 so that the recording medium (that has been nipped by the transfer belt 110 and the photosensitive bodies 107) can be removed therefrom. Further, an outer cover 10*a* is swingably provided on the top of the housing 10.

Two contact levers 116 are formed on the end (the left end in FIG. 2) of the support frame 115 opposing the fixing unit 104. Although only one contact lever 116 is shown in FIG. 2, two contact levers 116 are disposed on both sides of the support frame 115 in the width direction of the support frame 115. The contact levers 116 project toward the fixing unit 104. Each release member 121 of the fixing unit 104 has an upper lever 124 and a lower lever 125 both of which oppose the corresponding contact lever 116. The upper levers 124 and the lower levers 125 project in parallel with each other toward the support frame 115. The lower levers 125 are longer than the upper levers 124. When the support frame 115 is at the closing position (FIG. 1), each contact lever 116 positions between the upper lever 124 and the lower lever 125 of the release member 121.

The operation of the image forming apparatus will be described. The image forming operation is performed in a state where the support frame 115 is at the closing position (FIG. 1). First, the pickup roller 131 of the medium supply unit 106 rotates and successively picks up the recording medium. The delivery roller 132 and the feeding roller 133 rotate and feed the recording medium to the feeding path between the transfer belt 110 and the photosensitive bodies 107. The transfer belt 110 in the transferring-and-feeding unit 103 is moved by the rotation of the belt driving roller 112, and the photosensitive bodies 107 in the image forming portions 100 rotate, with the result that recording medium is fed along the feeding path. In each image forming portion 100, the optical unit 102 forms a latent image on the photosensitive body 107 according to the image data, and the developing unit 108 develops the latent image to form the toner image. The toner image on the photosensitive body 107 is transferred to the recording medium by means of the electrical charge on the transfer belt 110.

After the image forming portions 100 transfer the toner images of the respective colors on the recording medium, the recording medium is fed to the fixing unit 104, and is pressed and heated by the heat roller 117 and the pressure roller 118. After the toner image is fixed to the recording medium, the recording medium is ejected out of the housing 10 by the eject roller 126 and the feeding roller 127.

When the image forming operation is interrupted by the jam of the recording medium or the like, a user performs an operation (i.e., a jam-recovery operation) for removing the recording medium from the image forming apparatus. The user opens the outer cover 10*a* as shown in FIG. 2, and swings the support frame 115 from the closing position (FIG. 1) to the opening position (FIG. 2). As a result, the transfer belt 110 supported by the support frame 115 separates from the photosensitive bodies 107, and the feeding path of the recording medium is opened. Moreover, during the swinging of the support frame 115 to the opening position, the contact levers 116 urge the upper levers 124 of the release members 121 upward so that the release members 121 rotate counterclockwise in FIG. 2. The cam portions 123 of the release members 121 urge the shaft ends of the heat roller 117 downward, and therefore the heat roller 117 and the pressure roller 118 stop pressing the recording medium. Since the transfer belt 110 and the photosensitive bodies 107 separate from each other, and the heat roller 117 and simultaneously the pressure roller 118 stop pressing the recording medium, the recording medium can be easily removed from the feeding path and from the fixing unit 104.

After the user removes the recording medium, the user swings the support frame 115 from the opening position to the closing position. Then, the feeding path is again formed between the transfer belt 110 supported by the support frame 115 and the photosensitive bodies 107. Further, during the swinging of the support frame 115 to the closing position, the contact levers 116 urge the lower levers 125 of the release members 121 downward so that the release members 121 rotate clockwise in FIG. 2. Accordingly, the cam portions 123 of the release members 121 separate from the shaft ends of the heat roller 117. As a result, the heat roller 117 moves upward by the force of the pressing members 120, so that the heat roller 117 is pressed against the pressure roller 118.

As described above, according to the first embodiment, when the user swings the support frame 115 from the closing position toward the opening position, the transfer belt 110 separates from the photosensitive bodies 107 with the result that the feeding path is opened, and the heat roller 117 and the pressure roller 118 stop pressing the recording medium. Accordingly, it becomes easy to remove the recording medium from the feeding path and from the fixing unit 104.

Moreover, when the support frame 115 swings, the contact levers 116 of the support frame 115 abut against the release members 121 so that the release members 121 rotate. Therefore, the operation for separating the transfer belt 110 from the photosensitive bodies 107 can be linked with the operation for bringing the heat roller 117 and the pressing roller 118 to stop pressing the recording medium, by means of a relatively simple structure.

In this embodiment, the image forming portions 100 (including the photosensitive bodies 107) are fixed to the housing 10, and the transferring-and-feeding unit 103 (including the transfer belt 110) is swingable with respect to the housing 10. However, it is also possible that the transferring-and-feeding unit 103 is fixed to the housing 10 and the image forming portions 100 are swingable. In this case, it is possible that the heat roller 117 and the pressure roller 118 stop pressing the recording medium as the image forming portions 100 swing with respect to the housing 10, with the result that the above described advantages are obtained.

Second Embodiment.

Figure 3:
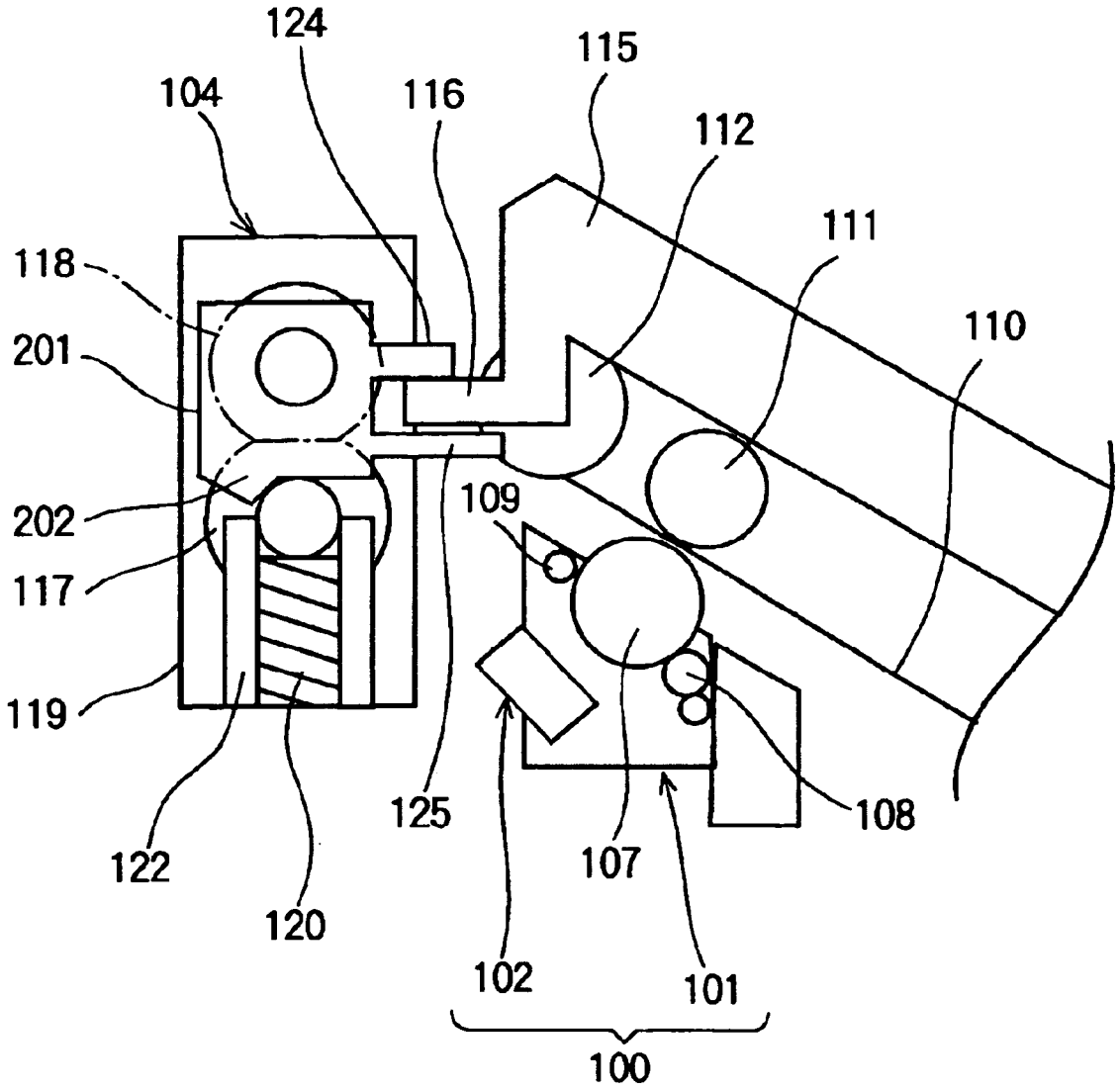
FIG. 3 is a sectional view of the main part of an image forming apparatus according to the second embodiment.
Figure 4:
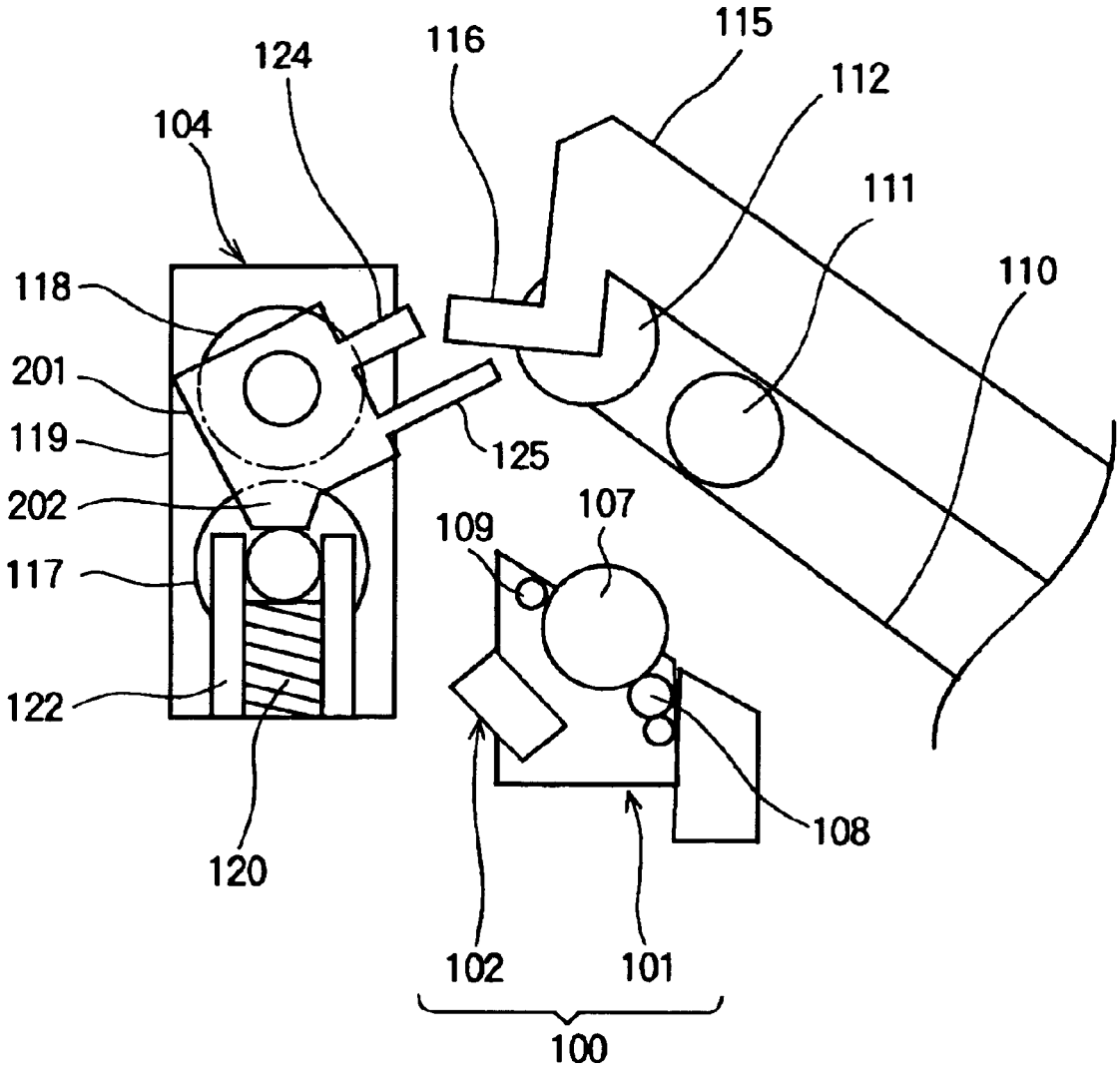
FIG. 4 is a is a sectional view illustrating the operation of the image forming apparatus according to the second embodiment.

FIGS. 3 and 4 are sectional views illustrating the main part of the image forming apparatus according to the second embodiment. In FIGS. 3 and 4, the components that are the same as those in the first embodiment are assigned the same reference numerals. In this embodiment, as in the first embodiment, the fixing unit 104 includes the heat roller 117, the pressure roller 118, the fixing unit cover 119 and the pressing members 120. The fixing unit 104 also includes two release members 201 for bringing the heat roller 117 and the pressure roller 118 to stop pressing the recording medium. Although only one release member 201 is shown in FIG. 3, two release members 201 are disposed on both sides of the pressure roller 118 in the longitudinal direction of the pressure roller 118. The release members 201 have cam portions 202 that abut against the shaft ends of the heat roller 117 and urge the heat roller 117 downward. Unlike the first embodiment, the cam portions 202 of the release members 201 are so constructed that, when the cam portions 202 urge the heat roller 117 downward, the heat roller 117 completely separates from the pressure roller 118 as shown in FIG. 4.

The jam-recovery operation in this embodiment will be described. When the user swings the support frame 115 from the closing position (FIG. 3) to the opening position, the transfer belt 110 supported by the support frame 115 separates from the photosensitive bodies 107. Further, the contact levers 116 of the support frame 115 urge the upper levers 124 of the release members 201 upward so that the release members 201 rotate counterclockwise in FIG. 3. As the release members 201 rotate counterclockwise, the cam portions 202 of the release members 201 urge the shaft ends of the heat roller 117 downward so that the heat roller 117 completely separates from the pressing roller 118. Since the transfer belt 110 and the photosensitive bodies 107 separate from each other, and simultaneously the heat roller 117 and the pressure roller 118 separate from each other, the recording medium can be easily removed from the feeding path and the fixing unit 104.

After the user removes the recording medium, the user swings the support frame 115 from the opening position to the closing position (FIG. 3). Then, the feeding path is again formed between the transfer belt 110 and the photosensitive bodies 107. Further, during the swinging of the support frame 115 to the closing position, the contact levers 116 urge the lower levers 125 of the release members 201 downward so that the release members 201 rotate clockwise in FIG. 3. By the rotation of the release members 201, the cam portions 201 of the release members 201 separate from the shaft ends of the heat roller 117. As a result, the heat roller 117 moves upward by the force of the pressing members 120, so that the heat roller 117 is pressed against the pressure roller 118.

As described above, according to the second embodiment, the heat roller 117 and the pressure roller 118 completely separate from each other, and therefore it becomes easier to remove the recording medium from the feeding path and from the fixing unit 104, in addition to the advantages of the first embodiment.

Third Embodiment.

Figure 5:
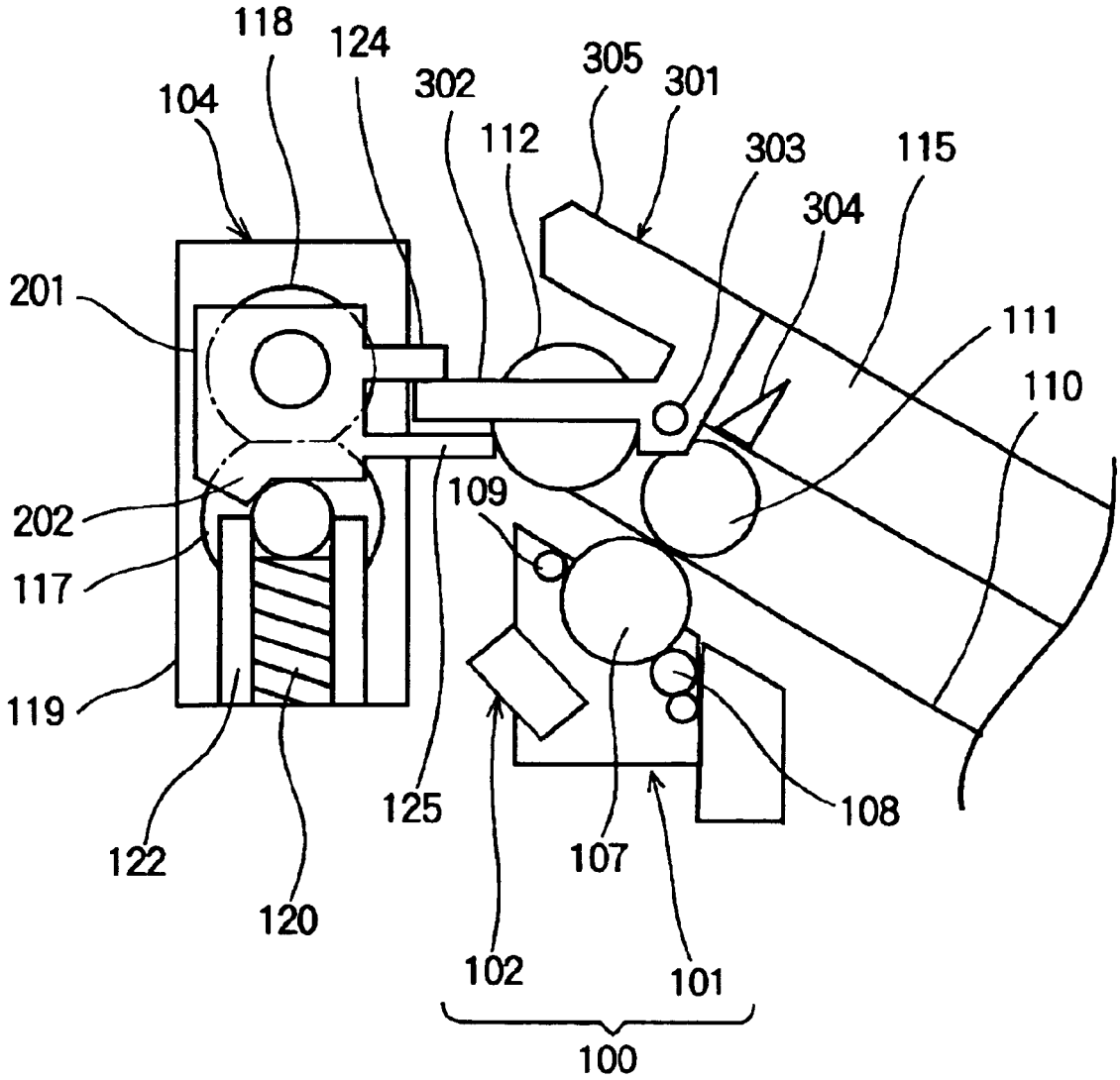
FIG. 5 is a sectional view of the main part of an image forming apparatus according to the third embodiment.
Figure 6:
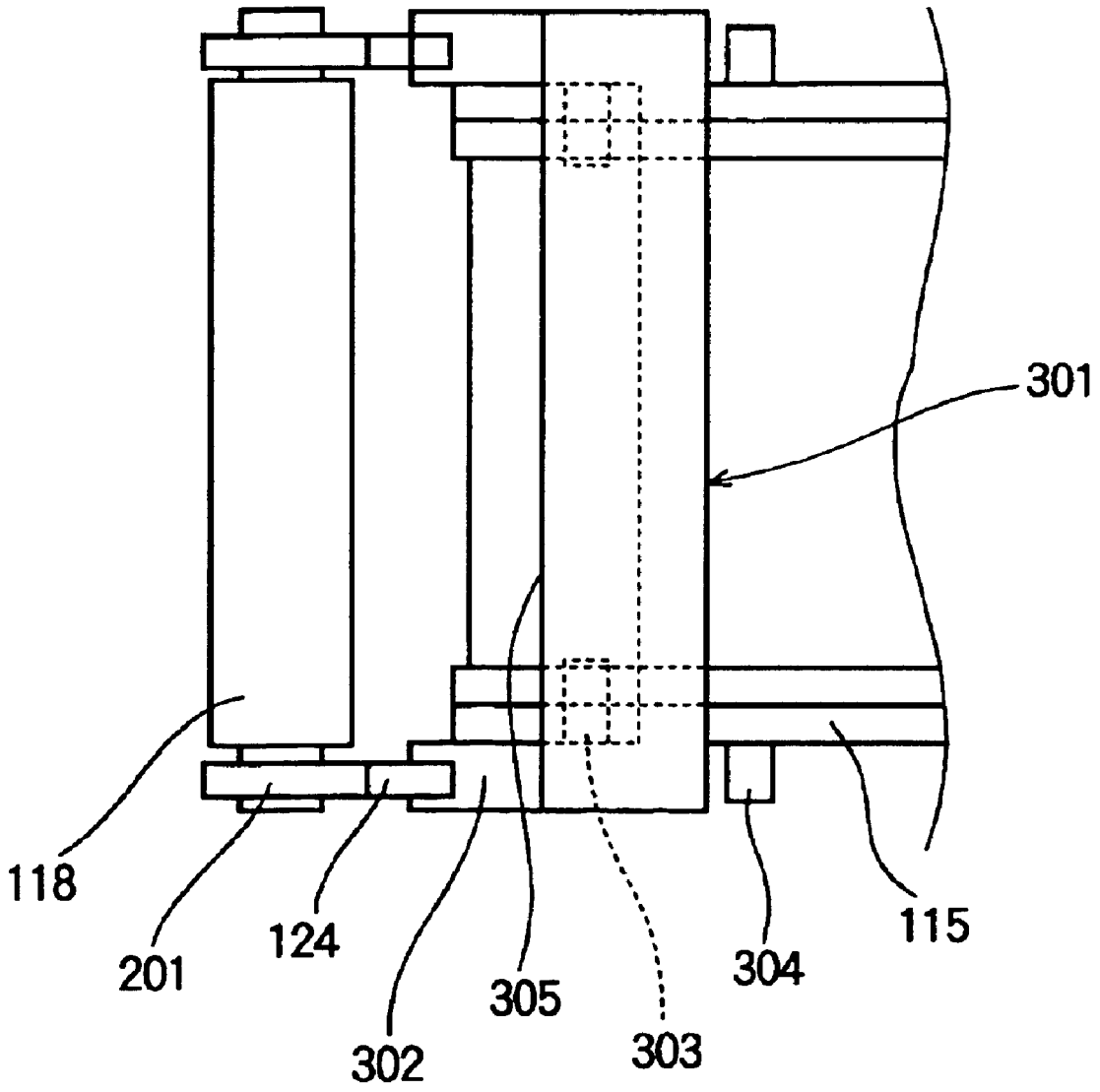
FIG. 6 is a plan view of the main part of the image forming apparatus according to the third embodiment.

FIGS. 5 and 6 are a sectional view and a plan view of the main part of the image forming apparatus according to the third embodiment. In FIGS. 5 and 6, the components that are the same as those in the first and second embodiments are assigned the same reference numerals. In this embodiment, as shown in FIG. 5, a swingable release lever 301 is mounted on the support frame 115. The swingable release lever 301 is disposed on an end (i.e., the left end in FIG. 5) of the support frame 115 opposing the fixing unit 104. The swingable release lever 301 is swingably supported by support shafts 303 formed on the support frame 115. The swingable release lever 301 has contact levers 302 projecting toward the fixing unit 104. As shown in FIG. 6, the contact levers 302 are disposed on both sides of the support frame 115 in the width direction of the support frame 115. The contact levers 302 are able to contact the upper levers 124 and the lower levers 125 (not shown in FIG. 6) of the release members 201.

As shown in FIG. 5, the swingable release lever 301 includes a grip portion 305 formed at the upper side of the contact levers 302. The grip portion 305 protrudes in such a direction that the gap between the grip portion 305 and the contact lever 302 increases. Further, the grip portion 305 extends in the width direction of the support frame 115 so that the user is able to hold the grip portion 305. In a position shown in FIG. 5, the contact levers 302 of the swingable release lever 301 position between the upper levers 124 and the lower levers 125 of the release members 201. The support frame 115 has stoppers 304 that contact the swingable release lever 301 when the swingable release lever 301 swings clockwise from the position shown in FIG. 5 by a certain angle. The support frame 115 has a not shown lock mechanism that locks the swingable release lever 301 at a position shown in FIG. 5.

Figure 7:
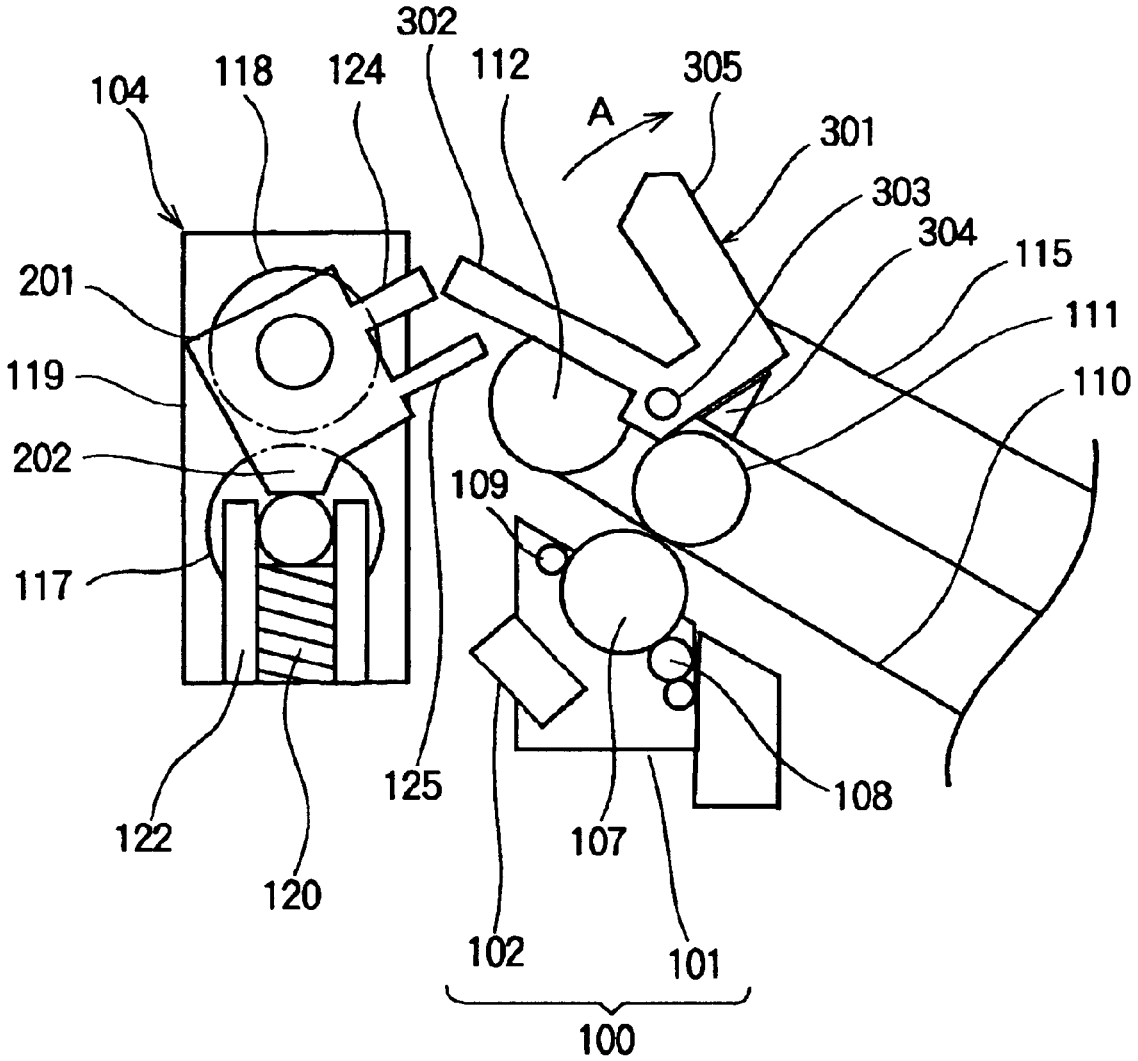
FIG. 7 is a sectional view illustrating the operation of the image forming apparatus according to the third embodiment.
Figure 8:
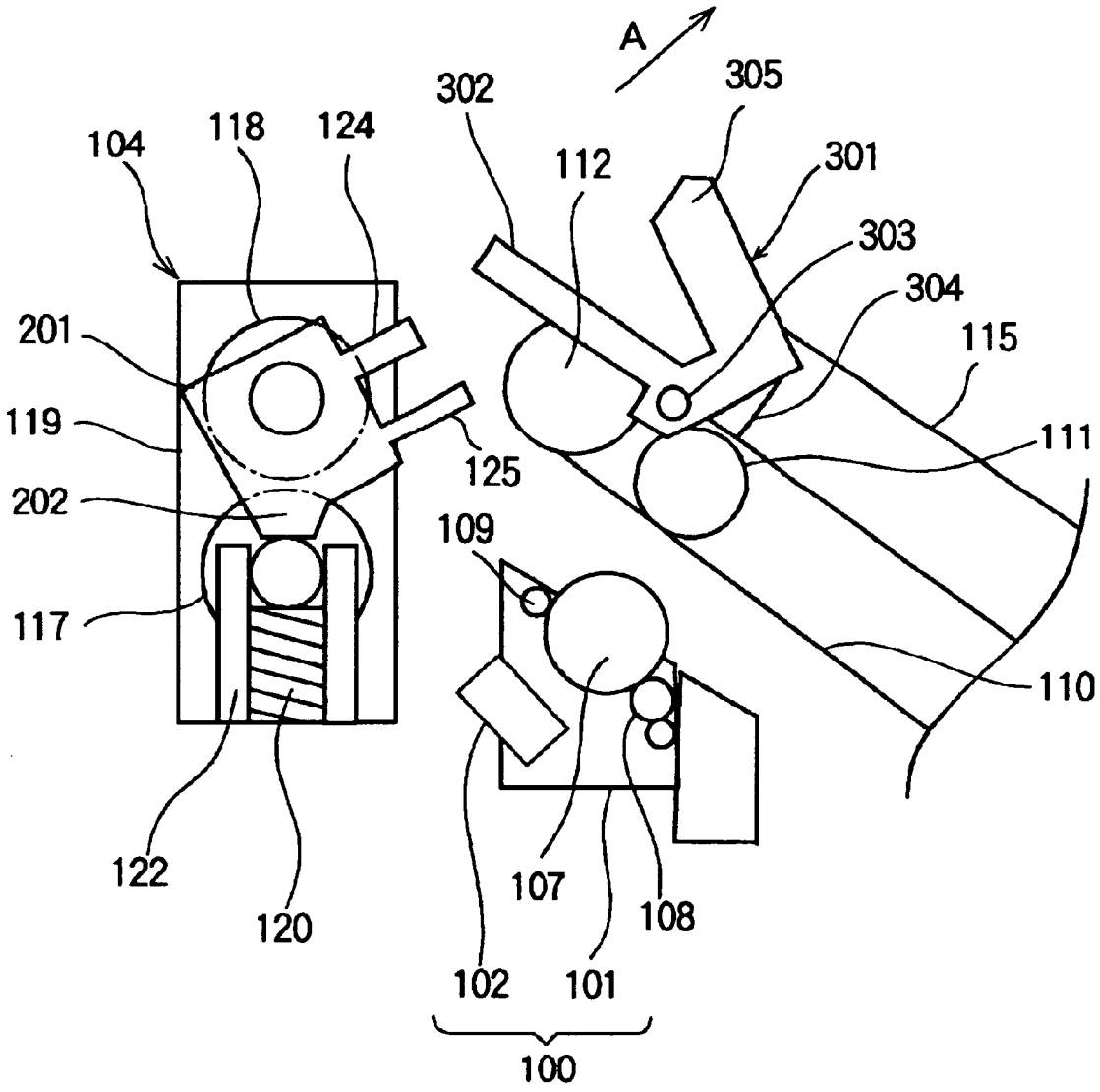
FIG. 8 is a sectional view illustrating the operation of the image forming apparatus according to the third embodiment.

FIG. 7 is a sectional view illustrating a state where the swingable release lever 301 swings from the position shown in FIG. 5. FIG. 8 is a sectional view illustrating a state where the support frame 115 swings from the position shown in FIG. 7. As shown in FIG. 7, when the swingable release lever 301 is pulled in a direction shown by an arrow A (i.e., the direction A), the swingable release lever 301 swings clockwise about the support shaft 303, and the contact levers 302 of the swingable release levers 301 urge the upper lever 124 of the release members 201 upward, so that the release members 201 rotate counterclockwise in FIG. 7. When the swingable release lever 301 is further pulled in the direction A, the swingable release lever 301 abut against the stoppers 304, and the support frame 115 starts swinging about the support shaft 130 (FIG. 1), with the result the feeding path of the recording medium is opened.

The jam recovery operation in this embodiment will be described. As shown in FIG. 7, when the user pulls the grip portion 305 of the swingable release lever 301 in the direction A, the swingable release lever 301 swings clockwise about the support shaft 303 until the swingable release lever 301 abuts against the stopper 304. As the swingable release lever 301 swings clockwise in FIG. 7, the contact levers 302 urge the upper levers 124 of the release members 201 upward so that the release members 201 rotate counterclockwise in FIG. 7. As the release members 201 rotate counterclockwise in FIG. 7, the cam portions 202 of the release members 201 urge the shaft ends of the heat roller 117 downward so that the heat roller 117 separates from the pressure roller 118. When the user further pulls the grip portion 305 of the swingable release lever 301 in the direction A, the support frame 115 swings to the opening position as shown in FIG. 8, and the transfer belt 110 separates from the photosensitive bodies 107, with the result that the feeding path of the recording medium is opened. Since the heat roller 117 and the pressure roller 118 separate from each other, and then the transfer belt 110 and the photosensitive bodies 107 separate from each other, the recording medium can be easily removed from the feeding path and the fixing unit 104.

After the user removes the recording medium, the user swings the support frame 115 from the opening position to the closing position (FIG. 7). Then, the feeding path is again formed between the transfer belt 110 and the photosensitive bodies 107. The support frame 115 is locked at the position shown by FIG. 7 by means of a not shown lock mechanism. Further, when user holds the grip portion 305 of the swingable release lever 301 and pushes the swingable release lever 301 in the direction opposite to the direction A, the contact levers 302 of the swingable release lever 301 urge the lower levers 125 of the release members 201 downward, so that the release members 201 rotate clockwise in FIG. 7. By the rotation of the release members 201, the cam portions 202 of the release members 201 separate from the shaft ends of the heat roller 117. As a result, the heat roller 117 moves upward by the force of the pressing members 120, so that the heat roller 117 is pressed against the pressure roller 118. Even if the user forgets to operate the swingable release lever 301, the outer cover 10*a* (FIG. 2) abuts against the swingable release lever 301 from above when the user closes the outer cover 10*a*, with the result that the release members 201 rotate as described above.

As described above, according to the third embodiment, the heat roller 117 and the pressure roller 118 separate from each other, before the transfer belt 110 and the photo sensitive bodies 107 separate from each other. Therefore, the recording medium may not adhere to the heat roller 117 or the pressure roller 118, but may adhere to the transfer belt 110 by the static electricity. Thus, even when the user pulls the recording medium bearing the unfixed toner image from the downstream side of the fixing unit 104, it is possible to prevent the unfixed toner from adhering to the heat roller 117 and the pressure roller 118.

Fourth Embodiment

Figure 9:
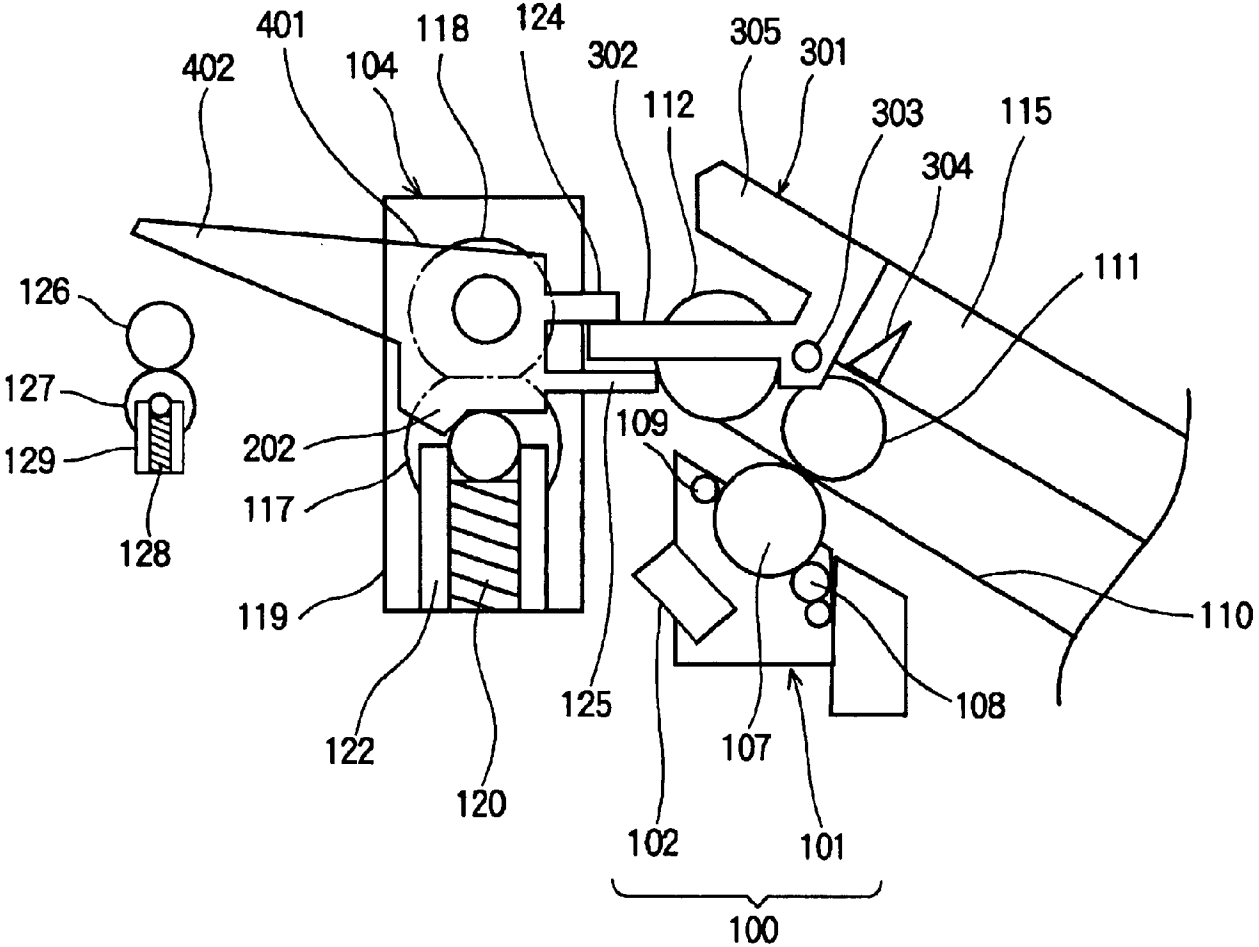
FIG. 9 is a sectional view of the main part of an image forming apparatus according to the fourth embodiment.
Figure 10:
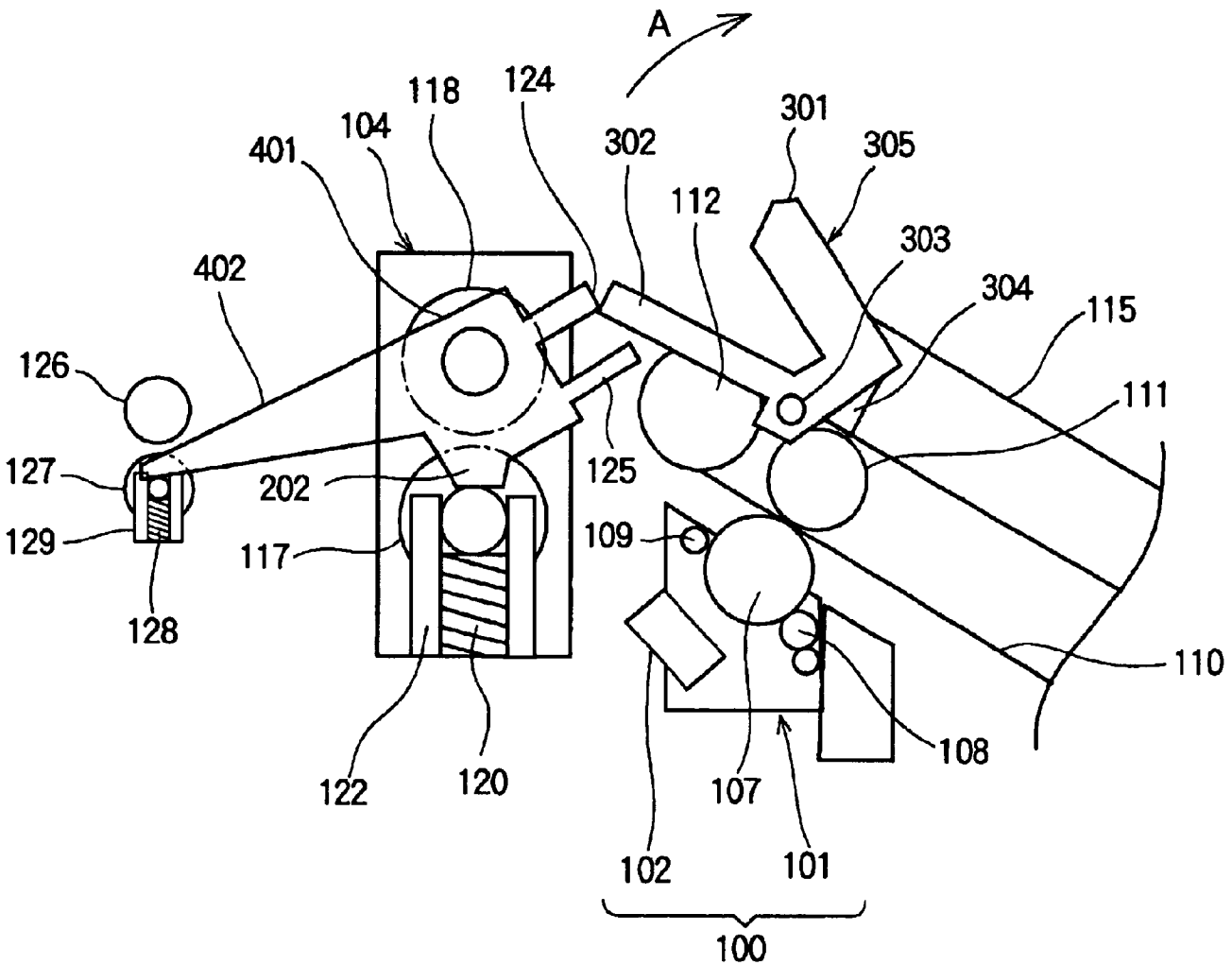
FIG. 10 is a sectional view illustrating the operation of the image forming apparatus according to the fourth embodiment.
Figure 11:
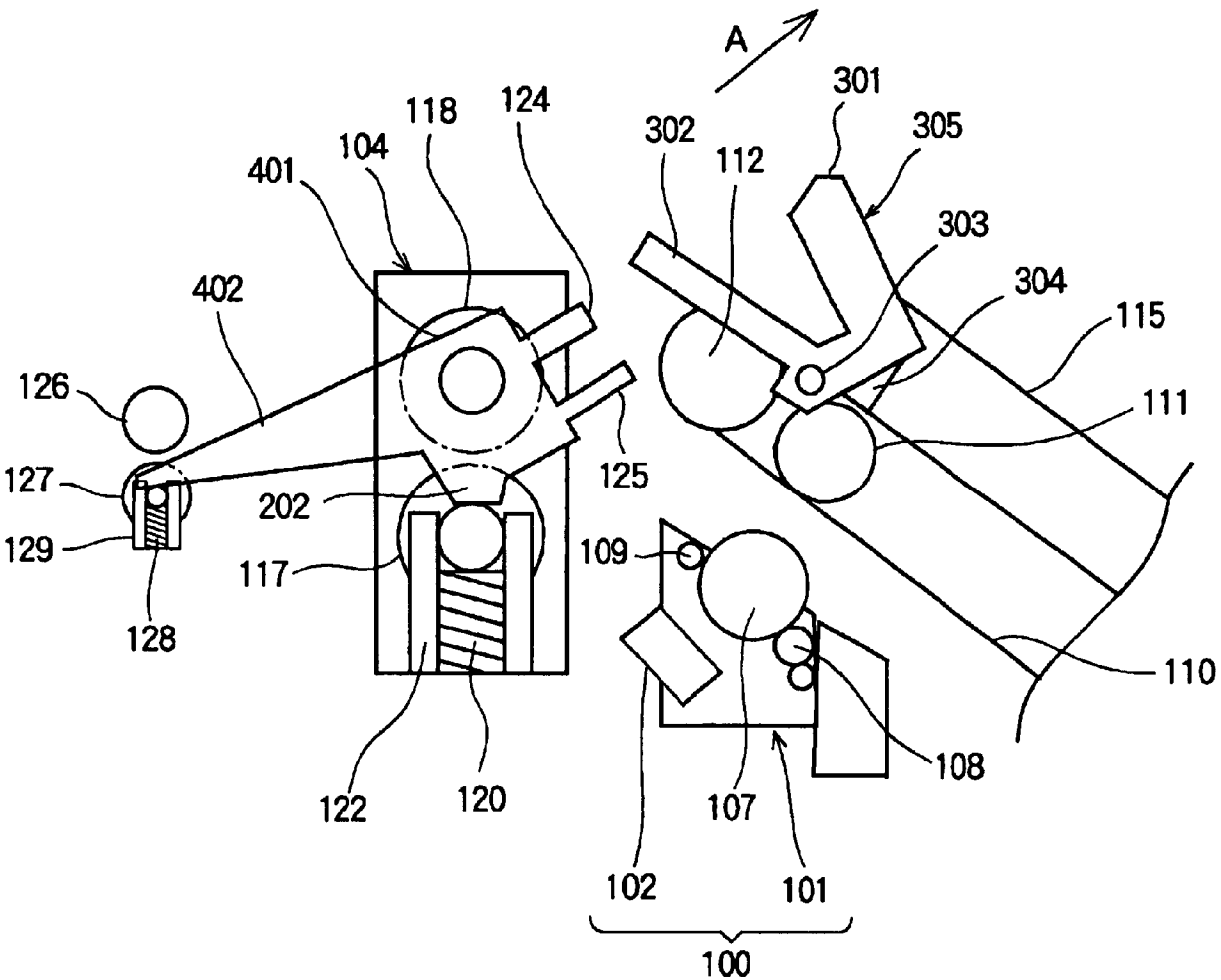
FIG. 11 is a sectional view illustrating the operation of the image forming apparatus according to the fourth embodiment.

FIGS. 9 through 11 are sectional views of the main part of the image forming apparatus. In FIGS. 9 through 11, the components that are the same as those in the above described embodiments are assigned the same reference numerals. In this embodiment, release members 401 have eject side levers 402 in addition to the above described upper and lower levers 124 and 125. The eject side levers 402 project toward the eject roller 126 (i.e., to the left in FIG. 9). The eject side levers 402 are long enough to be able to abut against the shaft ends of the feeding roller 127 from above. The feeding roller 127 is movably supported in the vertical direction, and urged in the direction toward the eject roller 126 by the force of the pressing members 128.

In this embodiment, when the release members 401 rotate counterclockwise in FIG. 9, the eject side levers 402 of the release members 401 abut against the shaft ends of the feeding roller 127 and urge the feeding roller 127 downward, so that the feeding roller 127 separates from the eject roller 126 as shown in FIG. 10. As was described in the third embodiment, the cam portions 202 of the release members 401 abut against the shaft ends of the heat roller 117 and urge the heat roller 117 downward, so that the heat roller 117 separates from the pressure roller 118.

The jam recovery operation in this embodiment will be described. As shown in FIG. 10, when the user pulls the grip portion 305 of the swingable release lever 301 in the direction A, the swingable release lever 301 swings clockwise about the support shafts 303 until the swingable release lever 301 abuts against the stoppers 304. During the swinging of the swingable release lever 301, the contact levers 302 urge the upper levers 124 of the release members 401 upward so that the release members 401 rotate counterclockwise in FIG. 10. As the release members 401 rotate counterclockwise, the cam portions 202 of the release members 401 urge the shaft ends of the heat roller 117 downward so that the heat roller 117 separates from the pressure roller 118. Simultaneously, the eject side levers 402 urge the shaft ends of the feeding roller 127 downward so that the feeding roller 127 separates from the eject roller 126. When the user further pulls the grip portion 305 of the swingable release lever 301 in the direction A, the transfer belt 110 supported by the support frame 115 separates from the photosensitive bodies 107 as shown in FIG. 11, with the result that the feeding path of the recording medium is opened. As described above, the recording medium can be easily removed from the nip portion between the eject roller 126 and the feeding roller 127, as well as the feeding path and the fixing unit 104.

After the user removes the recording medium, the user swings the support frame 115 from the opening position to the closing position. Then, the feeding path is again formed between the transfer belt 110 and the photosensitive bodies 107. Further, when the user holds the grip portion 305 of the swingable release lever 301 and pushes the swingable release lever 301 in the direction opposite to the direction A, the contact levers 302 of the swingable release lever 301 urge the lower levers 125 of the release members 401 downward, so that the release members 401 rotate clockwise in FIG. 10. By the rotation of the release members 401, the cam portions 202 of the release members 401 separate from the shaft end of the heat roller 117. As a result, the heat roller 117 moves upward by the force of the pressing members 120, so that the heat roller 117 is pressed against the pressure roller 118. Further, the eject side levers 402 of the release members 401 separate from the shaft ends of the feeding roller 127, and the feeding roller 127 moves upward by the force of the pressing members 128, so that the feeding roller 127 is again urged against the eject roller 126.

As described above, according to the fourth embodiment, the eject roller 126 and the feeding roller 127 separate from each other, as the transfer belt 110 and the photosensitive bodies 107 separate from each other and the heat roller 117 and the pressure roller 118 separate from each other. Thus, even if the recording medium is nipped between the eject roller 126 and the feeding roller 127, the recording medium can be easily removed therefrom.

Fifth Embodiment

Figure 12:
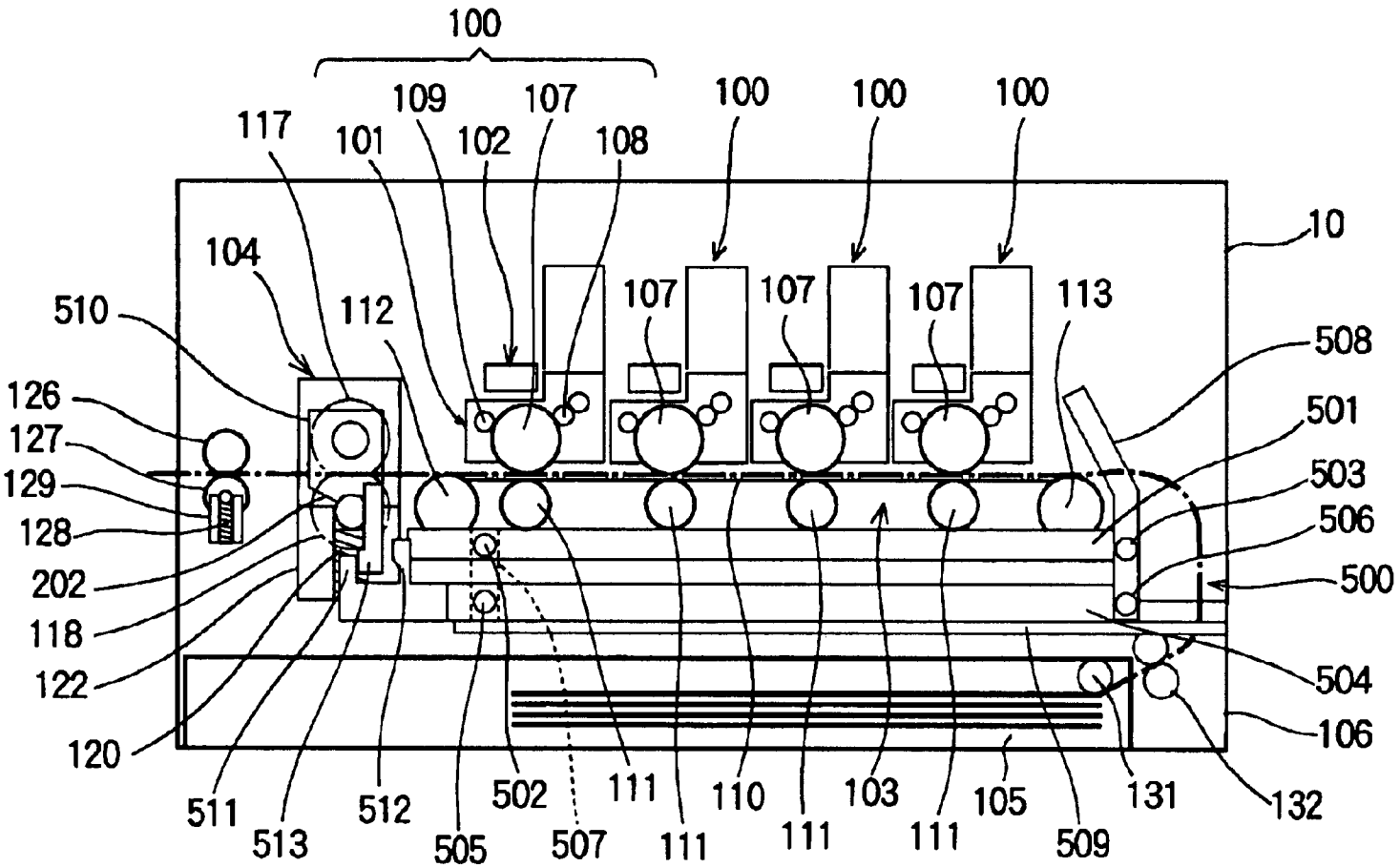
FIG. 12 is a sectional view of an image forming apparatus according to the fifth embodiment.
Figure 13:
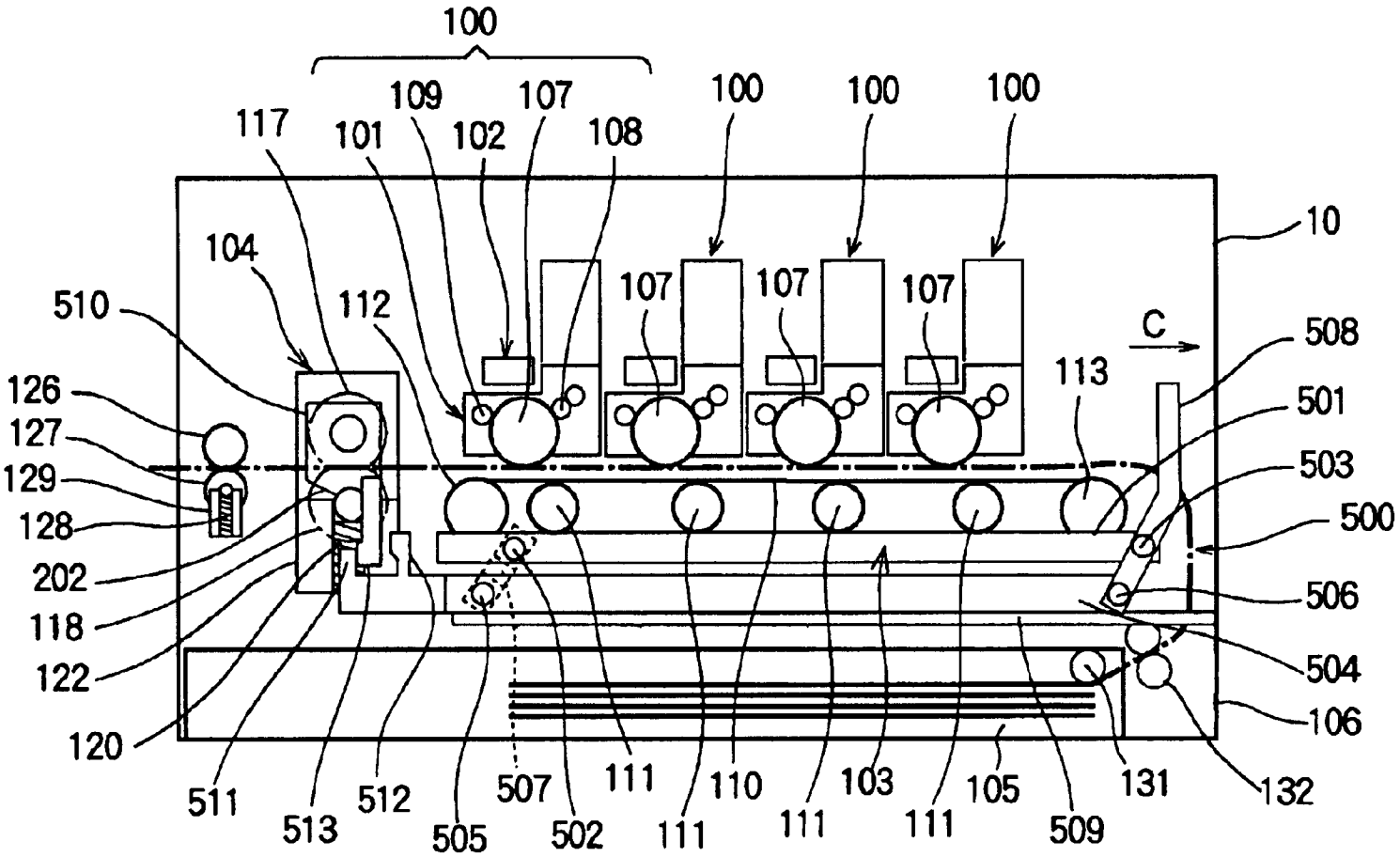
FIG. 13 is a sectional view illustrating the operation of the image forming apparatus according to the fifth embodiment.
Figure 14:
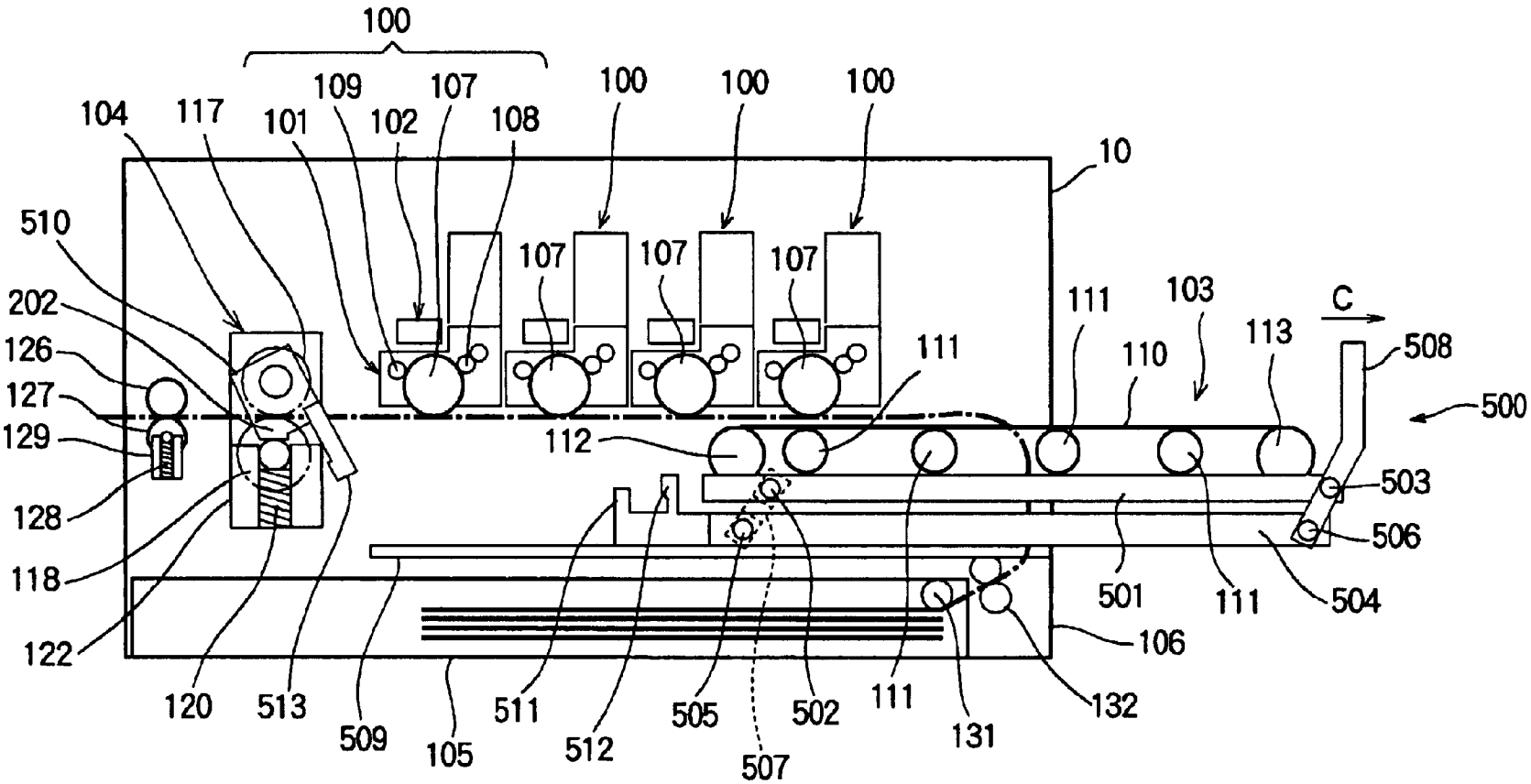
FIG. 14 is a sectional view illustrating the operation of the image forming apparatus according to the fifth embodiment.

FIGS. 12 through 14 are sectional views of the image forming apparatus according to fifth embodiment. In FIGS. 12 through 14, the components that are the same as those in the above described embodiments are assigned the same reference numerals. As shown in FIG. 12, four image forming portions 100 of this embodiment are aligned in the horizontal direction. As was described in the first embodiment, each image forming portion 100 includes the image drum cartridge 101 (including the photosensitive body 107, the developing unit 108, and the charging unit 109) and the optical unit 102 constituted by the LED head. The optical unit 102 is not limited to the LED head, but can be constituted by a laser scanning unit having a laser emitting portion and a polygon mirror.

The transferring-and-feeding unit 103 (including the transfer rollers 111 ) is disposed on the lower side of the image forming portions 100. Four transfer rollers 111 of the transferring-and-feeding unit 103 are aligned in the horizontal direction so that the transfer rollers 111 respectively oppose the photosensitive bodies 107. The belt driving roller 112 and the tension applying roller 113 are disposed on both sides of four transfer rollers 111 in the direction (i.e., left-right direction in FIG. 12) in which the transfer rollers 111 are aligned. The transfer belt 110 is stretched over the belt driving roller 112 and the tension applying roller 113. By the rotation of the belt driving roller 112, the transfer belt 110 moves along the feeding path between the transfer belt 110 and the photosensitive bodies 107 from the right to the left in FIG. 12.

The transferring-and-feeding unit 103 is supported by a movable frame 500. The movable frame 500 is slidable along rails 509 extending in a direction (i.e., left-right direction in FIG. 12) in which the transfer rollers 111 are aligned. The movable frame 500 has upper and lower frames 501 and 504. The upper and lower frames 501 and 504 are linked by link levers 507 via support shafts 502 and 505 formed at the downstream ends (i.e., the left ends in FIG. 12) of the upper and lower frames 501 and 504. Although one link lever 507 is shown in FIG. 13, two link levers 507 are disposed on both sides of the movable frame 500 in the width direction of the movable frame 500. Further, the upper and lower frames 501 and 504 are linked by link levers 508 via support shafts 503 and 506 formed at the upstream ends (i.e., the right ends in FIG. 12) of the upper and lower frames 501 and 504. The link levers 508 extend upward beyond the upper frame 501 so that the user is able to hold the link levers 508.

As shown in FIG. 13, when the link levers 508 are pulled in the direction denoted by an arrow C (i.e., the direction C), the link levers 507 and 508 swing clockwise in FIG. 13 about the support shafts 505 and 506. By the swinging of the link levers 507 and 508, the upper frame 501 substantially moves to the lower right as shown in FIG. 13. As a result, the transfer belt 110 of the transferring-and-feeding unit 103 supported by the upper frame 501 separates from the photosensitive bodies 107 of the image forming portions 100 fixed in the housing 10. In this state, the link levers 508 abut against not shown stoppers, so that the link levers 508 do not swing further in the direction C.

The lower frame 504 has contact levers 511 at the downstream end thereof. Although one contact lever 511 is shown in FIG. 13, two contact levers 511 are disposed on both sides of the lower frame 504 in the width direction of the lower frame 504. Further, the lower frame 504 has contact levers 512 disposed on the upstream side of the respective contact levers 511. The contact levers 511 and 512 are disposed on the downstream side of the above described support shafts 505. The contact levers 511 and 512 protrude upward toward the fixing unit 104. The protruding amounts of the contact levers 512 are greater than those of the contact levers 511.

In the fixing unit 104 in this embodiment, the heat roller 117 is disposed on the upper side of the pressure roller 118. The pressure roller 118 is supported by the guide members 122 so that the pressure roller 118 is movable in the vertical direction. The release members 510 are rotatable about the shaft of the heat roller 117, and has cam portions 202 that urge the shaft ends of the pressure roller 118 downward. Further, the release members 510 have protrusions 513 formed at positions where the protrusions 513 are able to contact the contact levers 511 and 512.

As shown in FIG. 14, when the link levers 508 are further moved in the direction C, the movable frame 500 moves along the rails 509 to the exterior of the housing 10. During this movement of the movable frame 500, the contact levers 511 of the lower frame 504 contact the protrusions 513 of the release members 510, and therefore the release members 510 rotate counterclockwise in FIG. 14. Conversely, when the lower frame 504 moves in the direction opposite to the direction C, the contact levers 512 of the lower frame 504 abut against the protrusions 513 of the release members 510, so that the release members 510 rotate clockwise in FIG. 14.

The jam recovery operation in this embodiment will be described. As shown in FIG. 13, when the user pulls the link levers 508 in the direction C, the link levers 507 and 508 swing about the support shafts 505 and 506 so that the upper frame 501 moves substantially to the lower right as shown in FIG. 13. The transfer belt 110 supported by the upper frame 501 separates from the photosensitive bodies 107. When the user further pulls the link lever 508 in the direction C, the movable frame 500 moves along the rails 509 to the exterior of the housing 10 as shown in FIG. 14. Accordingly, it becomes possible to remove the recording medium adhering to the transfer belt 110 supported by the movable frame 500. Moreover, during the movement of the movable frame 500 to the exterior of the housing 10, the contact levers 511 of the lower frame 504 contact the protrusions 513 of the release members 510 so that the release members 510 rotate counterclockwise in FIG. 14. As the release members 510 rotate counterclockwise, the cam portions 202 of the release members 510 urge the shaft ends of the pressure roller 118 downward so that the pressure roller 118 separates from the heat roller 117. Since the heat roller 117 and the pressure roller 118 separate from each other (as the transfer belt 110 moves to the exterior of the housing 10) after the transfer belt 110 separates from the photosensitive bodies 107, the recording medium can be easily removed from the feeding path and from the fixing unit 104.

After the user removes the recording medium, the user holds the link levers 508 and moves the movable frame 500 in the direction opposite to the direction C. As the movable frame 500 moves along the rails 509 into the housing 10, the contact levers 512 abut against the protrusions 513 of the release members 510, so that the release members 510 rotate clockwise in FIG. 13. As a result, the cam portions 202 of the release members 510 separate from the shaft ends of the pressure roller 118, and therefore the pressure roller 118 moves upward by the force of the pressing members 120 and again urged against the heat roller 117. When the user further pushes the link lever 508 in the direction opposite to the direction C, the link levers 507 and 508 swing about the support shafts 505 and 506, with the result that the upper frame 501 moves to the upper left as shown in FIG. 13. Thus, the feeding path is again formed between the transfer belt 110 and the photosensitive bodies 107.

As described above, according to the fifth embodiment, the transfer belt 110 separates from the photosensitive bodies 107 by the operation of the link levers 508, and then the heat roller 117 and the pressure roller 118 separate from each other as the movable frame 500 moves to the exterior of the housing 10. Therefore, it becomes easy to remove the recording medium from the feeding path and the fixing unit 14. Particularly, since the transfer belt 110 supported by the movable frame 500 moves to the exterior of the housing 10, it becomes easier to remove the recording medium adhering to the transfer belt 110.

Figure 15:
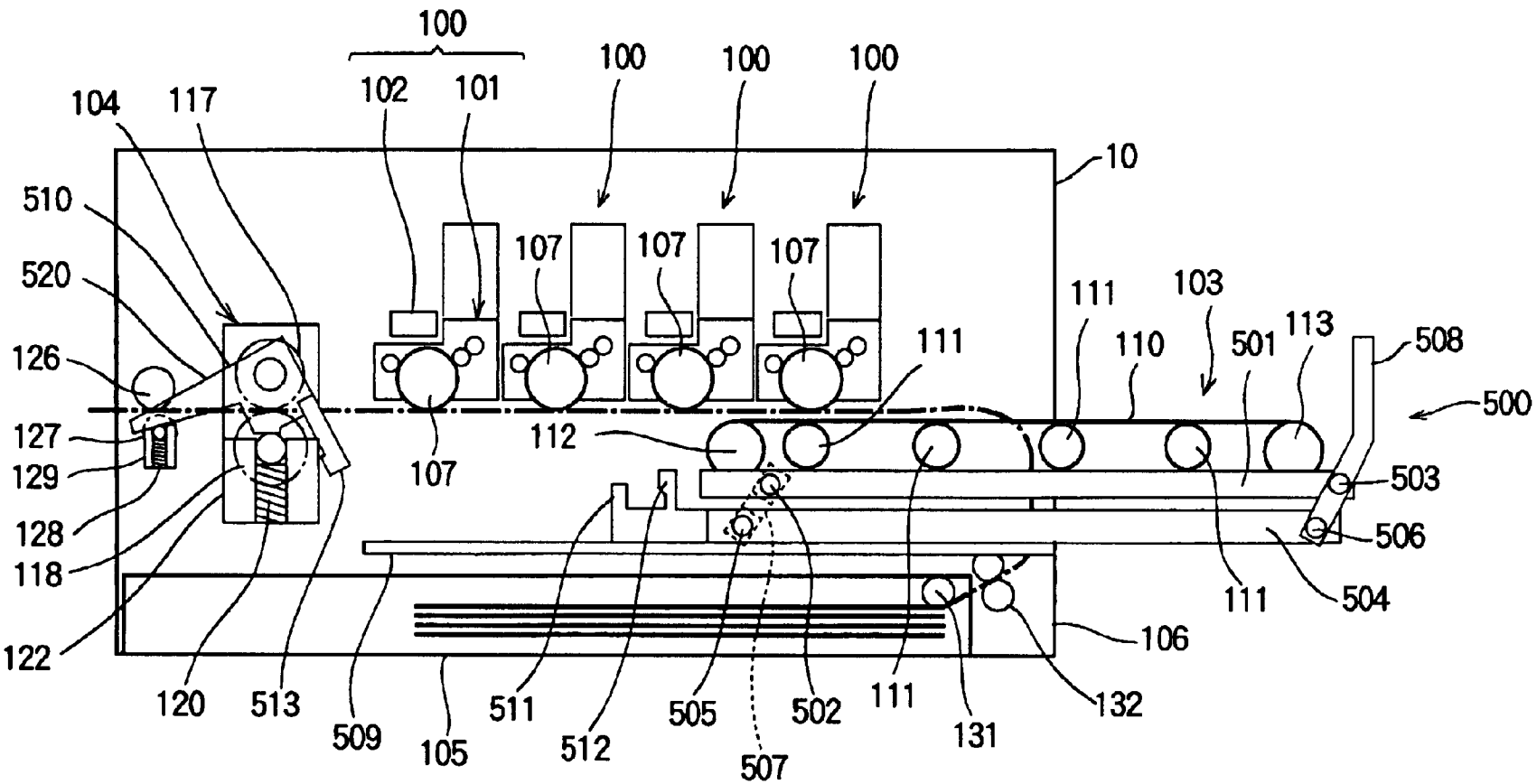
FIG. 15 is a sectional view of an image forming apparatus according to the alternative arrangement of the fifth embodiment.

FIG. 15 shows an alternative arrangement of the fifth embodiment. In the alternative arrangement, the release members 510 have eject side levers 520 protruding toward the eject roller 126, i.e., to the left in FIG. 15. When the release members 510 rotate counterclockwise in FIG. 15 during the movement of the movable frame 500 to the exterior of the housing 10, the eject side levers 520 abut against the shaft ends of the feeding roller 127 from above and urge the feeding roller 127 downward, with the result that the feeding roller 127 separates from the eject roller 126. The other structure and operation of the alternative arrangement are the same as those of the fifth embodiment.

According to the alternative arrangement, the heat roller 117 and the pressure roller 118 separate from each other, and the eject roller 126 and the feeding roller 127 also separate from each other, as the movable frame 500 moves to the exterior of the housing 10. Therefore, even when the recording medium is nipped by the eject roller 126 and the feeding roller 127, the recording medium can be easily removed therefrom.

Sixth Embodiment

Figure 16:
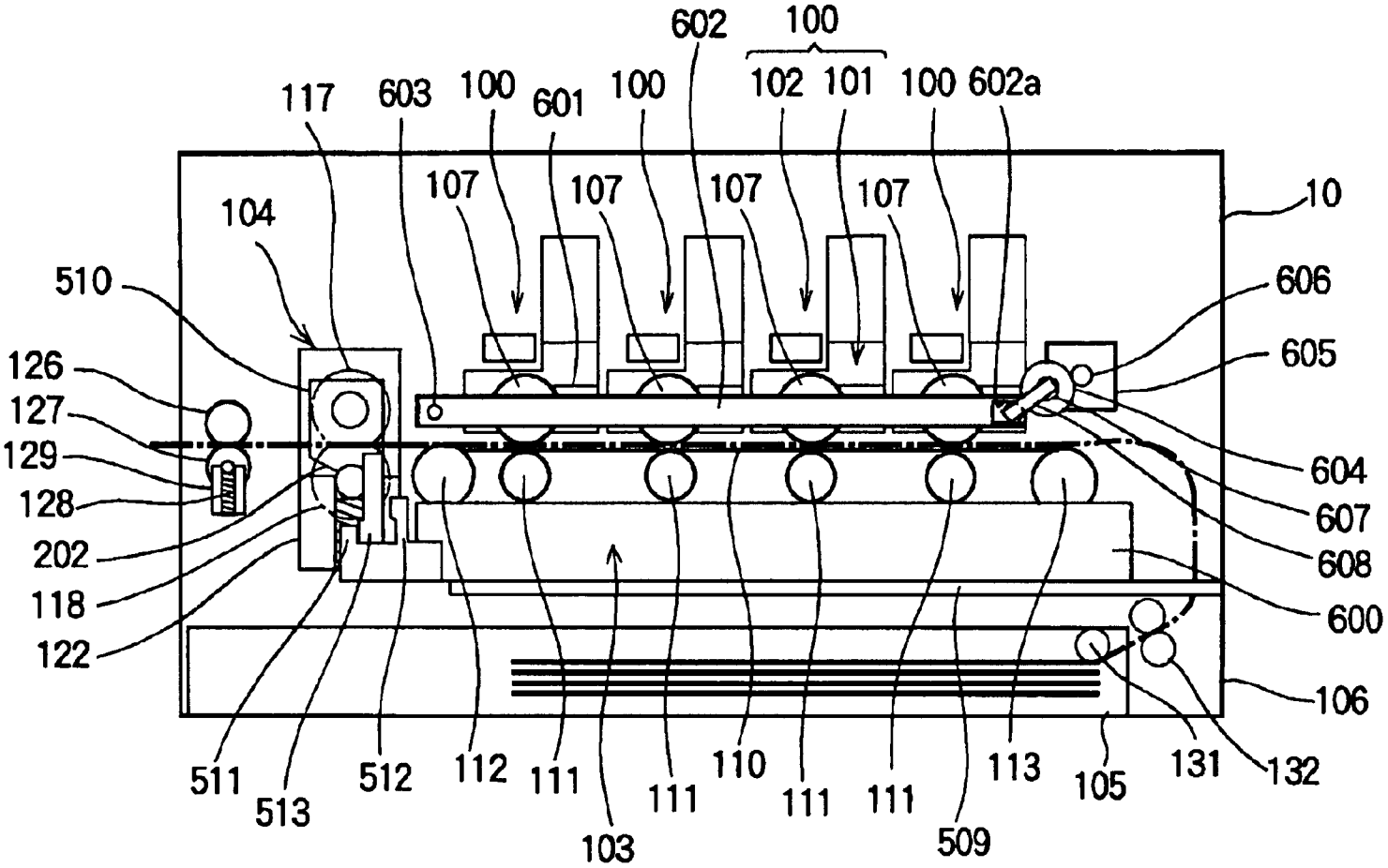
FIG. 16 is a sectional view of an image forming apparatus according to the sixth embodiment.
Figure 17:
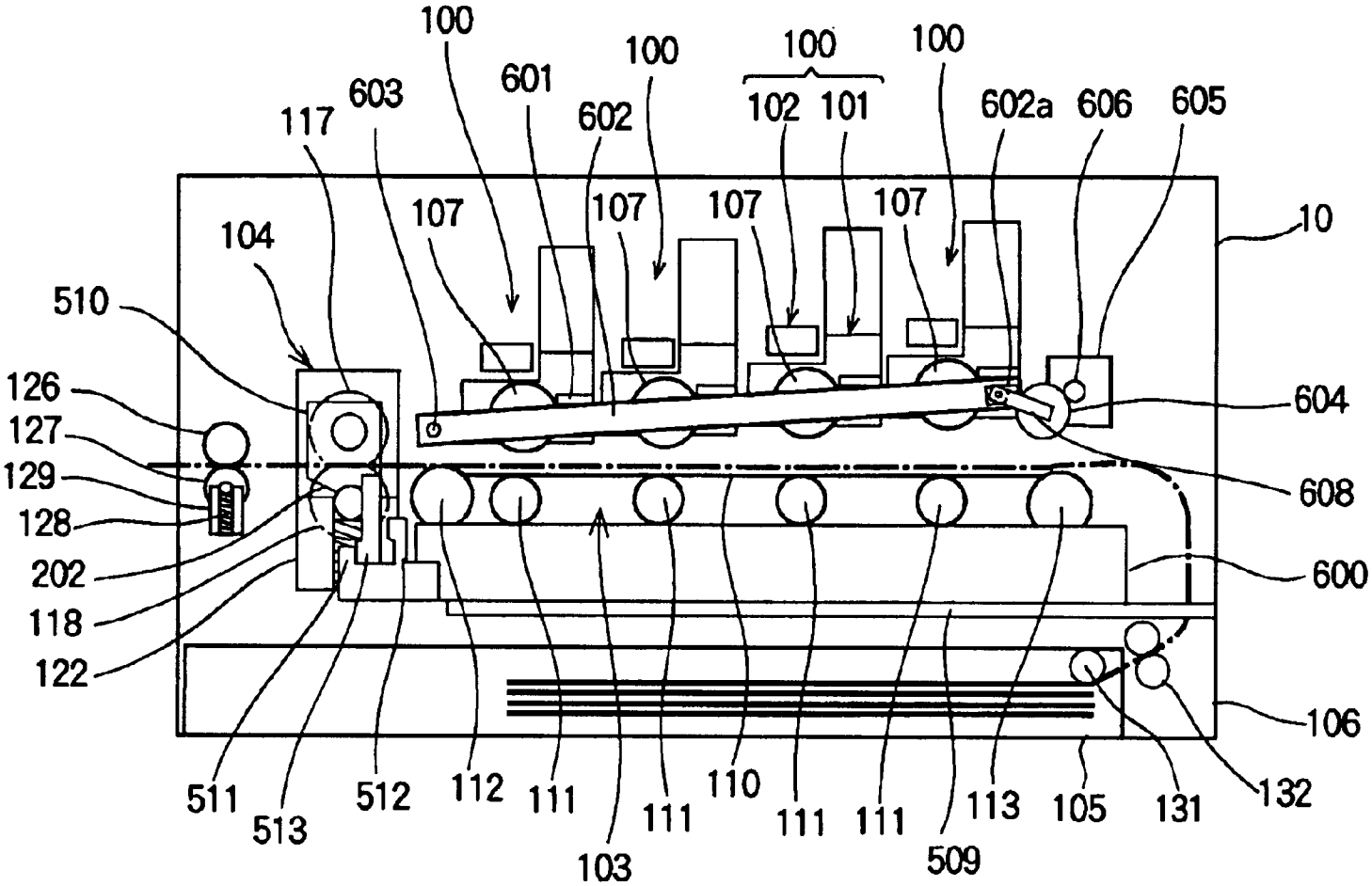
FIG. 17 is a sectional view illustrating the operation of the image forming apparatus according to the sixth embodiment.
Figure 18:
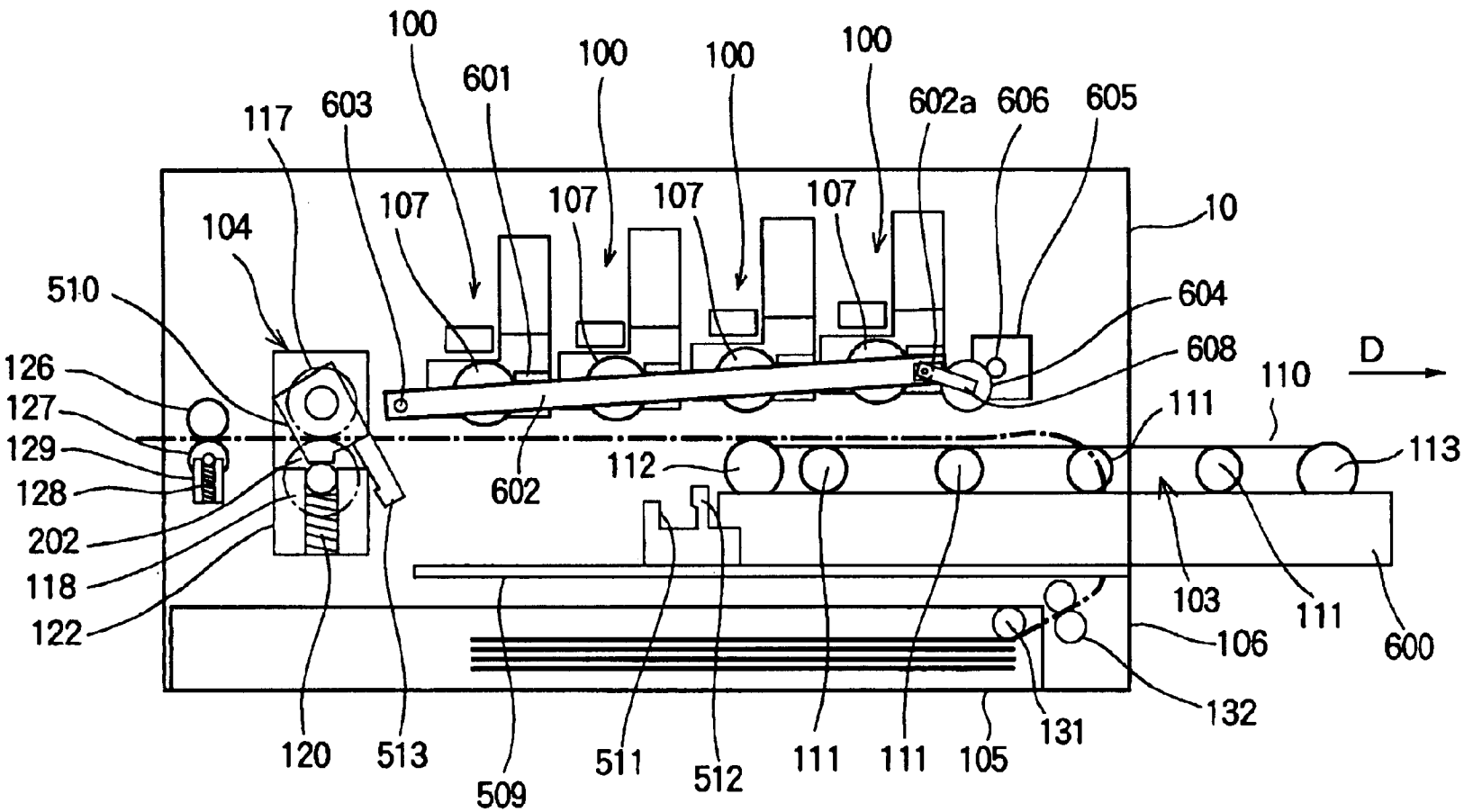
FIG. 18 is a sectional view illustrating the operation of the image forming apparatus according to the fifth embodiment.

FIGS. 16 through 18 are sectional views of the image forming apparatus according to the sixth embodiment. In FIGS. 16 through 18, the components that are the same as those in the above described embodiments are assigned the same reference numerals. In this embodiment, four image forming portions 100 are supported by a support arm 602 that substantially extends in the horizontal direction. As described in the first embodiment, each image forming portions 100 includes the image drum cartridge 101 and the optical unit 102. The support arm 602 abuts against projections 601 formed on the surface of the image drum cartridge 101 from below.

The transferring-and-feeding unit 103 is disposed on the lower side of the image forming portions 100. In the transferring-and-feeding unit 103, four transfer rollers 111 are aligned in the horizontal direction so that the transfer rollers 111 respectively oppose the photosensitive bodies 107. The belt driving roller 112 and the tension applying roller 113 are disposed on both sides of the four transfer rollers 111 in the direction (i.e., left-right direction in FIG. 16) in which the transfer rollers 111 are aligned. The transfer belt 110 is stretched over the belt driving roller 112 and the tension applying roller 113. The transfer belt 110 moves along the feeding path between the transfer roller 111 and the photosensitive bodies 107 from the right to the left in FIG. 16.

The transferring-and-feeding unit 103 is detachably mounted to a movable frame 600. The movable frame 600 is movable along the rails 509 extending in the direction (i.e., the left-right direction in FIG. 16) in which the transfer rollers 111 are aligned.

The support arm 602 is swingable substantially in the vertical direction about a support shaft 603 formed at the downstream end thereof (i.e., the left end in FIG. 16). The upstream end (i.e., the right end in FIG. 16) of the support arm 602 is linked with a driving lever 608 provided for swinging the support arm 602. The driving lever 608 has a not show pin that engages a groove 602a formed on the upstream end of the support arm 602. The driving lever 608 is fixed to a gear 604 rotatable about a support shaft 607. The gear 604 engages a motor gear 606 fixed to a shaft of a motor 605. As the motor 605 rotates, the rotation of the motor 605 is transmitted via the motor gear 606 to the gear 604. As the gear 604 rotates, the driving lever 608 swings upward, with the result that the support arm 602 swings upward as shown in FIG. 17.

As was described in the fifth embodiment, the contact levers 511 and the contact levers 512 protrude upward from the downstream end (i.e., the left end) of the movable frame 600 of the transferring-and-feeding unit 103. The protruding amounts of the contact levers 512 are greater than those of the contact levers 511. The structure of the fixing unit 104 is the same as that of the fifth embodiment, and therefore the release members 510 have the protrusions 513 that are able to contact the contact levers 511 and 512.

As shown in FIG. 18, when the movable frame 600 moves along the rails 509 in the direction indicated by an arrow D (i.e., the direction D), the transferring-and-feeding unit 103 supported by the movable frame 600 moves to the exterior of the housing 10. During the movement of the movable frame 600, the contact levers 511 of the movable frame 600 abut against the protrusions 513 of the release members 510 so that the release members 510 rotate counterclockwise in FIG. 18.

The jam recovery operation in this embodiment will be described. In this jam recovery operation, a controller (not shown) of the image forming apparatus drives the motor 605 so that the motor 605 rotates in the normal direction, i.e., counterclockwise in FIG. 16. The rotation of the motor 605 is transmitted via the motor gear 606 to the gear 604, and the driving lever 608 fixed to the gear 604 swings upward, with the result that the support arm 602 swings upward. As a result, the image forming portions 100 supported by the support arm 602 move upward, and therefore the photosensitive bodies 107 separate from the transfer belt 110, so that the feeding path of the recording medium is opened. The controller of the image forming apparatus stops the rotation of the motor 605 after the motor 605 rotates by a certain amount. Then, as shown in FIG. 18, the user operates a not shown operation member to move the movable frame 600 in the direction D to the exterior of the housing 10. During the movement of the movable frame 600, the contact levers 511 of the movable frame 600 abut against the protrusions 513 of the release members 510 so that the release members 510 rotate counterclockwise in FIG. 18. By the rotation of the release members 510, the cam portions 202 of the release members 510 urge the shaft ends of the pressure roller 118 downward, with the result that the pressure roller 118 separates from the heat roller 117. As described above, the transfer belt 110 and the photosensitive bodies 107 separate from each other, and then the heat roller 117 and the pressure roller 118 separate from each other as the transferring-and-feeding unit 103 (supported by the movable frame 600) moves to the exterior of the housing 10. Accordingly, the recording medium can be easily removed from the feeding path and the fixing unit 104.

After the user removes the recording medium, the user moves the movable frame 600 in the direction opposite to the direction D, and then the contact levers 512 abut against the protrusions 513 of the release members 510, so that the release members 510 rotate clockwise as shown in FIG. 17. As a result, the cam portions 202 of the release members 510 move away from the shaft ends of the pressure roller 118, and therefore the pressure roller 118 moves upward by the force of the pressing members 120 and urged against the heat roller 118. After the transferring-and-feeding unit 103 is pushed in the housing 10, the controller of the image forming apparatus drives the motor 605 in the reverse direction (i.e., clockwise in FIG. 17), with the result that the support arm 602 swings downward. As the support arm 602 swings downward, the image forming portions 100 (including the photosensitive bodies 107) supported by the support arm 602 moves down, and therefore the feeding path is again formed between the transfer belt 110 and the photosensitive bodies 107.

As described above, according to the sixth embodiment, the photosensitive bodies 107 separate from the transfer belt 110 by means of the motor 605, and then the heat roller 117 and the pressure roller 118 separate from each other as the movable frame 600 moves to the exterior of the housing 10. Therefore, the recording medium may easily remain on the transfer belt 110, with result that the user can easily remove the recording medium therefrom.

In this sixth embodiment, as in the alternative arrangement of the fifth embodiment, it is possible that the release members 510 have the eject side levers 520 (FIG. 15). In this case, when the heat roller 117 and the pressure roller 118 separate from each other, the eject roller 126 and the feeding roller 127 also separate from each other. With such an arrangement, even if the recording medium is nipped between the eject roller 126 and the feeding roller 127, the recording medium can be easily removed therefrom.

In the above described second to sixth embodiments, the release members 201, 401 and 510 cause the heat roller 117 and the pressure roller 118 to completely separate from each other. However, it is possible that the release members 201, 401 and 501 only bring the heat roller 117 and the pressure roller 118 to stop pressing the recording medium as was described in the first embodiment.

Further, in the above described fourth embodiment, the release members causes the eject roller 126 and the feeding roller 127 to completely separate from each other. However, it is possible that the release members only brings the eject roller 126 and the feeding roller 127 to stop nipping the recording medium.

Moreover, in the above described first and sixth embodiments, the description has been made to the tandem-type image forming apparatus in which the plurality of image forming portions 100 are aligned in a row. However, the present invention can be adapted to an image forming apparatus other than the tandem-type image forming apparatus. Further, the image forming apparatus can be a printer, a facsimile, a photocopier or the like.

While the preferred embodiments of the present invention have been illustrated in detail, it should be apparent that modifications and improvements may be made to the invention without departing from the spirit and scope of the invention as described in the following claims.

What is claimed is:

1. An image forming apparatus comprising:

an image bearing body that bears a developer image formed by developer;

a transfer body that transfers said developer image to a recording medium, said transfer body feeding said recording medium;

a separating mechanism that separates said image bearing body and said transfer body from each other;

a fixing unit that fixes said developer image to said recording medium, said fixing unit including a heating body and a pressure body;

a pressing mechanism that presses said heating body and said pressure body against each other so that said recording medium is pressed between said heating body and said pressure body; and a release mechanism that brings said pressing mechanism to stop pressing said heating body and said pressure body, said release mechanism being linked with said separating mechanism such that separating said image bearing body and said transfer body from each other causes said pressing mechanism to stop pressing;

wherein said pressing mechanism includes a pressing member that presses said heating body and said pressure body against each other;

wherein said release mechanism, in order to stop pressing of said heating body and said pressure body, restrains said pressing member; and wherein said release mechanism stops restraining said pressing member, in order to press said heating body and said pressure body.

2. The image forming apparatus according to claim 1, wherein said release mechanism brings said pressing mechanism to stop pressing said heating body and said pressure body, after said separating mechanism separates said image bearing body and said transfer body from each other.

3. The image forming apparatus according to claim 1, wherein said release mechanism causes one of said heating body and said pressure body to move away from the other of said heating body and said pressure body.

4. The image forming apparatus according to claim 1, further comprising a feeding mechanism that nips said recording medium therebetween and feeds said recording medium, wherein said release mechanism brings said feeding mechanism to stop nipping said recording medium, in association with said separating mechanism.

5. The image forming apparatus according to claim 4, wherein said release mechanism brings said feeding mechanism to stop nipping said recording medium, after said separating mechanism separates said image bearing body and said transfer body from each other.

6. An image forming apparatus comprising: an image bearing body that bears a developer image formed by developer;

a transfer body that transfers said developer image to a recording medium, said transfer body feeding said recording medium;

a separating mechanism that separates said image bearing body and said transfer body from each other;

a fixing unit that fixes said developer image to said recording medium, said fixing unit including a heating body and a pressure body;

a pressing mechanism that presses said heating body and said pressure body against each other so that said recording medium is pressed between said heating body and said pressure body; and a release mechanism that brings said pressing mechanism to stop pressing said heating body and said pressure body, said release mechanism being linked with said separating mechanism;

wherein said release mechanism brings said pressing mechanism to stop pressing said heating body and said pressure body, before said separating mechanism separates said image bearing body and said transfer body from each other.

7. An image forming apparatus comprising: an image bearing body that bears a developer image formed by developer;

a transfer body that transfers said developer image to a recording medium, said transfer body feeding said recording medium;

a separating mechanism that separates said image bearing body and said transfer body from each other;

a fixing unit that fixes said developer image to said recording medium, said fixing unit including a heating body and a pressure body;

a pressing mechanism that presses said heating body and said pressure body against each other so that said recording medium is pressed between said heating body and said pressure body; and a release mechanism that brings said pressing mechanism to stop pressing said heating body and said pressure body, said release mechanism being linked with said separating mechanism;

further comprising a feeding mechanism that nips said recording medium therebetween and feeds said recording medium, wherein said release mechanism brings said feeding mechanism to stop nipping said recording medium, in association with said separating mechanism;

wherein said release mechanism brings said feeding mechanism to stop nipping said recording medium, before said separating mechanism separates said image bearing body and said transfer body from each other.

8. An image forming apparatus comprising: an image bearing body that bears a developer image formed by developer;

a transfer body that transfers said developer image to a recording medium, said transfer body feeding said recording medium;

a separating mechanism that separates said image bearing body and said transfer body from each other;

a fixing unit that fixes said developer image to said recording medium, said fixing unit including a heating body and a pressure body;

a pressing mechanism that presses said heating body and said pressure body against each other so that said recording medium is pressed between said heating body and said pressure body; and a release mechanism that brings said pressing mechanism to stop pressing said heating body and said pressure body, said release mechanism being linked with said separating mechanism;

wherein said separating mechanism has a swingable support frame that supports one of said image bearing body and said transfer body, and said release mechanism is urged by said support frame so that said release mechanism moves one of said heating body and said pressure body in the direction away from the other of said heating body and said pressure body.

9. An image forming apparatus comprising: an image bearing body that bears a developer image formed by developer;

a transfer body that transfers said developer image to a recording medium, said transfer body feeding said recording medium;

a separating mechanism that separates said image bearing body and said transfer body from each other;

a fixing unit that fixes said developer image to said recording medium, said fixing unit including a heating body and a pressure body;

a pressing mechanism that presses said heating body and said pressure body against each other so that said recording medium is pressed between said heating body and said pressure body; and a release mechanism that brings said pressing mechanism to stop pressing said heating body and said pressure body, said release mechanism being linked with said separating mechanism;

wherein said separating mechanism has a swingable support frame that supports one of said image bearing body and said transfer body, said support frame has a swingable release lever, and said release mechanism is urged by said swingable release lever so that said release mechanism moves one of said heating body and said pressure body in the direction away from the other of said heating body and said pressure body.

10. An image forming apparatus comprising: an image bearing body that bears a developer image formed by developer;

a transfer body that transfers said developer image to a recording medium, said transfer body feeding said recording medium;

a separating mechanism that separates said image bearing body and said transfer body from each other;

a fixing unit that fixes said developer image to said recording medium, said fixing unit including a heating body and a pressure body;

a pressing mechanism that presses said heating body and said pressure body against each other so that said recording medium is pressed between said heating body and said pressure body; and a release mechanism that brings said pressing mechanism to stop pressing said heating body and said pressure body, said release mechanism being linked with said separating mechanism;

wherein said separating mechanism has a movable frame capable of moving to the exterior of said image forming apparatus, and said release mechanism is urged by said movable frame so that said release mechanism moves one of said heating body and said pressure body in the direction away from the other of said heating body and said pressure body.

* * * * *